US012628868B2

(12) United States Patent
Jackson et al.

(10) Patent No.: US 12,628,868 B2
(45) Date of Patent: May 19, 2026

(54) AEROSOL DELIVERY DEVICE

(71) Applicant: R. J. Reynolds Tobacco Company, Winston Salem, NC (US)

(72) Inventors: Thaddeus Jackson, Summerfield, NC (US); Jared Aller, Winston Salem, NC (US); Billy T. Conner, Clemmons, NC (US); Bill Webb, San Francisco, CA (US); Chris Harsacky, San Francisco, CA (US); Daniel Warren Rennecker, Naperville, IL (US); Matthew Joel Nettenstrom, Bartlett, IL (US); Steven Michael Schennum, Plainfield, IL (US)

(73) Assignee: R. J. REYNOLDS TOBACCO COMPANY, Winston-Salem, NC (US)

( * ) Notice: Subject to any disclaimer, the term of this patent is extended or adjusted under 35 U.S.C. 154(b) by 743 days.

(21) Appl. No.: 17/314,210

(22) Filed: May 7, 2021

(65) Prior Publication Data

US 2021/0345667 A1 Nov. 11, 2021

Related U.S. Application Data

(60) Provisional application No. 63/170,155, filed on Apr. 2, 2021, provisional application No. 63/021,871, filed on May 8, 2020.

(51) Int. Cl.
*A24F 40/42* (2020.01)
*A24F 40/20* (2020.01)
(Continued)

(52) U.S. Cl.
CPC ..... *A24F 40/42* (2020.01); *A24F 40/20* (2020.01); *A24F 42/10* (2020.01); *A24F 42/60* (2020.01)

(58) Field of Classification Search
CPC ..... A24F 42/10; A24F 42/60
See application file for complete search history.

(56) References Cited

U.S. PATENT DOCUMENTS 1,464,300 A 8/1923 Taff
1,505,655 A 8/1924 Marek
(Continued)

FOREIGN PATENT DOCUMENTS

CN 208676379 U 4/2019
GB 2473264 A 9/2011
(Continued)

OTHER PUBLICATIONS

International Search Report in the corresponding International Application No. PCT/IB2021/053903, dated Jul. 13, 2021, 6 pages.

*Primary Examiner* — Russell E Sparks
(74) *Attorney, Agent, or Firm* — Womble Bond Dickinson (US) LLP

(57) ABSTRACT

The present disclosure is directed to an aerosol delivery device and a holder for use with a removable substrate cartridge. In one implementation, the holder includes a main body defining a proximal end and a distal end, the main body further providing an aerosol passageway that extends through at least a portion of the main body, and a heat sink portion. At least part of the receiving chamber is located in the heat sink portion, and the heat sink portion is configured to dissipate heat from a substrate cartridge. Some implementations further include a cartridge retention assembly and a sliding assembly. The sliding assembly is configured to slide relative to the main body to and from at least a loading position, wherein the cartridge retention assembly is configured to receive a substrate cartridge, and a use position, wherein the cartridge retention assembly is configured to retain a substrate cartridge.

11 Claims, 20 Drawing Sheets

(51) Int. Cl.
*A24F 42/10* (2020.01)
*A24F 42/60* (2020.01)

(56) References Cited

U.S. PATENT DOCUMENTS 1,541,891 A 6/1925 Becker
1,607,132 A 11/1926 Kuno
1,613,545 A 1/1927 Teigen
1,941,531 A 1/1934 Blankenship
2,008,433 A 7/1935 Ashour
2,373,629 A 4/1945 Kilgore
2,455,492 A 12/1948 Jackson
2,502,831 A 4/1950 Daze
2,541,837 A 2/1951 Schroff
2,701,571 A 2/1955 Dittrich
2,711,176 A 6/1955 Vakilian
2,779,340 A 1/1957 Mansfield
2,953,136 A 9/1960 Dahly
3,155,099 A 11/1964 Minchin
3,181,538 A 5/1965 Piliego
3,685,520 A 8/1972 Chernack
4,708,151 A 11/1987 Shelar
4,714,082 A 12/1987 Banerjee et al.
4,966,171 A 10/1990 Serrano et al.
4,991,606 A 2/1991 Serrano et al.
5,040,552 A 8/1991 Schleich et al.
5,060,676 A 10/1991 Hearn et al.
5,076,296 A 12/1991 Nystrom et al.
5,159,940 A 11/1992 Hayward et al.
5,178,165 A 1/1993 DeFelice
5,240,012 A 8/1993 Ehrman et al.
5,592,955 A 1/1997 Keritsis
5,595,577 A 1/1997 Bensalem et al.
5,692,525 A 12/1997 Counts et al.
5,845,649 A 12/1998 Saito et al.
6,006,757 A 12/1999 Lichtenberg
6,053,176 A 4/2000 Adams et al.
6,164,287 A 12/2000 White
6,311,694 B1 11/2001 Nichols et al.
6,345,625 B1 2/2002 Chew
6,371,127 B1 4/2002 Snaidr et al.
6,431,177 B1 8/2002 Sieggen et al.
6,532,965 B1 3/2003 Abhulimen et al.
6,615,843 B2 9/2003 Pera
6,748,955 B2 6/2004 Snaidr et al.
7,080,649 B2 7/2006 Hcu
7,503,330 B2 3/2009 Borschke et al.
7,600,517 B1 10/2009 Holzrichter
7,624,739 B2 12/2009 Snaidr et al.
8,061,361 B2 11/2011 Maeder et al.
8,151,803 B2 4/2012 Inagaki
8,302,611 B2 11/2012 Rowley
8,528,567 B2 9/2013 Hajaligol
8,616,217 B2 12/2013 Tsurizumi et al.
8,776,803 B2 7/2014 Tarora et al.
8,863,754 B2 10/2014 Renaud et al.
8,915,255 B2 12/2014 Poget et al.
9,078,473 B2 7/2015 Worm et al.
9,149,072 B2 10/2015 Conner et al.
9,220,301 B2 12/2015 Banerjee et al.
9,282,769 B2 3/2016 Mishra et al.
9,301,546 B2 4/2016 Thomas et al.
9,332,784 B2 5/2016 Banerjee et al.
9,439,453 B2 9/2016 Conner et al.
9,532,591 B2 1/2017 Mironov
9,549,572 B2 1/2017 Dincer et al.
9,609,893 B2 4/2017 Novak, III et al.
9,629,393 B2 4/2017 Stolz et al.
9,693,587 B2 7/2017 Plojoux
9,717,273 B2 8/2017 Poget et al.
9,730,468 B2 8/2017 Poget et al.
9,801,412 B2 10/2017 Grant
9,894,930 B2 2/2018 Bonici et al.
9,918,494 B2 3/2018 Mironov et al.
9,930,915 B2 4/2018 Worm et al.
9,936,733 B2 * 4/2018 Ampolini ..... H02J 7/00
9,943,114 B2 4/2018 Batista
9,961,939 B2 5/2018 Reevell
10,022,014 B2 7/2018 Mateos Martin et al.
10,034,493 B2 7/2018 Akiyama et al.
10,062,015 B2 8/2018 Besehanic
10,064,428 B2 9/2018 Swepston et al.
10,064,478 B2 9/2018 Brooks
10,082,015 B2 9/2018 Williams et al.
10,102,013 B2 10/2018 Preston et al.
10,111,463 B2 10/2018 Batista
10,132,009 B2 11/2018 Chou et al.
10,159,277 B2 12/2018 Bonnely
10,212,014 B2 2/2019 Qu et al.
10,212,968 B2 2/2019 Mironov et al.
10,222,015 B2 3/2019 Chien
10,251,421 B2 * 4/2019 Kieslich ..... A24F 42/10
10,262,017 B2 4/2019 Wolge
10,291,991 B2 5/2019 Shan et al.
10,301,990 B2 5/2019 De Smet et al.
10,302,018 B2 5/2019 Venter
10,312,017 B2 6/2019 Huang et al.
10,398,168 B2 9/2019 Maiwald et al.
10,470,491 B2 11/2019 Sutton et al.
10,492,526 B2 12/2019 Sampson et al.
10,524,503 B2 1/2020 Florack et al.
10,827,780 B2 11/2020 Swepston et al.
2008/0047570 A1 2/2008 Plank
2009/0065011 A1 3/2009 Maeder et al.
2011/0083674 A1 4/2011 Karpinsky
2013/0133675 A1 5/2013 Shinozaki et al.
2013/0167850 A1 7/2013 Al-Aawar
2013/0228190 A1 9/2013 Weiss et al.
2014/0048085 A1 2/2014 Cox
2015/0034100 A1 2/2015 Park et al.
2015/0040924 A1 2/2015 Mironov et al.
2015/0296882 A1 10/2015 Mironov et al.
2015/0342254 A1 12/2015 Mironov et al.
2016/0007648 A1 1/2016 Sutton et al.
2016/0007649 A1 1/2016 Sampson et al.
2016/0120216 A1 5/2016 Mironov et al.
2016/0135495 A1 5/2016 Poget et al.
2016/0174609 A1 6/2016 Mironov
2016/0192704 A1 7/2016 Bonnely
2016/0316816 A1 11/2016 Lavanchy et al.
2016/0360785 A1 12/2016 Bless et al.
2017/0000189 A1 1/2017 Mironov et al.
2017/0055577 A1 3/2017 Batista
2017/0055578 A1 3/2017 Oda et al.
2017/0164654 A1 6/2017 Ademe
2017/0196261 A1 7/2017 Borges De Couraca et al.
2017/0303585 A1 10/2017 Florack et al.
2017/0318859 A1 11/2017 Batista
2018/0000165 A1 1/2018 Liu
2018/0014571 A1 1/2018 Nakano
2018/0070640 A1 3/2018 Bessant et al.
2018/0116280 A1 5/2018 Maiwald et al.
2018/0192707 A1 7/2018 Worm et al.
2018/0317560 A1 11/2018 Shinozaki et al.
2018/0325167 A1 11/2018 Grant
2018/0368468 A1 12/2018 Mishra et al.
2019/0000135 A1 1/2019 Lavanant et al.
2019/0000141 A1 1/2019 Rojo-Calderon et al.
2019/0000142 A1 1/2019 Lavanchy et al.
2019/0014818 A1 1/2019 Saygili
2019/0014820 A1 1/2019 Malgat
2019/0014821 A1 1/2019 Batista et al.
2019/0014823 A1 1/2019 Sur
2019/0059449 A1 2/2019 Akiyama et al.
2019/0059450 A1 2/2019 Akiyama et al.
2019/0075848 A1 3/2019 Worm et al.
2019/0124972 A1 5/2019 Nakano
2019/0124973 A1 5/2019 Nakano et al.
2019/0133176 A1 5/2019 Nakano et al.
2019/0150505 A1 5/2019 Ceppi et al.
2019/0274358 A1 9/2019 Reevell
2020/0015519 A1 1/2020 Conner et al.
2020/0060333 A1 2/2020 Sutton et al.
2020/0146349 A1 5/2020 Phillips et al.

(56) References Cited

U.S. PATENT DOCUMENTS

| | | | | |
|---|---|---|---|---|
| 2020/0268044 | A1 | 8/2020 | Wilson | |
| 2020/0359691 | A1* | 11/2020 | Lindars | A24F 40/48 |
| 2021/0015172 | A1 | 1/2021 | Conner et al. | |
| 2021/0015174 | A1 | 1/2021 | Cox et al. | |
| 2021/0015175 | A1 | 1/2021 | Jackson et al. | |

FOREIGN PATENT DOCUMENTS

| | | | |
|---|---|---|---|
| JP | 2002034543 | | 2/2002 |
| WO | WO1995034226 | | 12/1995 |
| WO | WO1998054989 | | 12/1998 |
| WO | WO2009022232 | | 2/2009 |
| WO | WO2013072336 | | 5/2013 |
| WO | WO2013083963 | | 6/2013 |
| WO | 2013/102609 | A2 | 7/2013 |
| WO | WO2013149810 | | 10/2013 |
| WO | WO2013189836 | | 12/2013 |
| WO | WO2014037270 | | 3/2014 |
| WO | WO2014156838 | | 10/2014 |
| WO | WO2014180893 | | 11/2014 |
| WO | WO2015097005 | | 7/2015 |
| WO | WO2015128384 | | 9/2015 |
| WO | WO2015151158 | | 10/2015 |
| WO | WO2015184744 | | 12/2015 |
| WO | WO2015197850 | | 12/2015 |
| WO | 2016/124550 | A1 | 8/2016 |
| WO | WO2017042297 | | 3/2017 |
| WO | WO2017108912 | | 6/2017 |
| WO | WO2017114760 | | 7/2017 |
| WO | WO2017115181 | | 7/2017 |
| WO | WO2017115182 | | 7/2017 |
| WO | WO2017115183 | | 7/2017 |
| WO | WO2017115184 | | 7/2017 |
| WO | WO2017115185 | | 7/2017 |
| WO | WO2017115188 | | 7/2017 |
| WO | WO2017115196 | | 7/2017 |
| WO | WO2017207442 | | 12/2017 |
| WO | WO2017212284 | | 12/2017 |
| WO | WO2018170800 | | 9/2018 |
| WO | WO2018201655 | | 11/2018 |
| WO | WO2019010680 | | 1/2019 |
| WO | 2019/072131 | A1 | 4/2019 |
| WO | WO2020216762 | | 10/2020 |

* cited by examiner

AEROSOL DELIVERY DEVICE

CROSS-REFERENCE TO RELATED APPLICATIONS

This application claims priority to, and the benefit of, U.S. Provisional Patent Application No. 63/021,871, titled Aerosol Delivery Device, filed on May 8, 2020, and U.S. Provisional Patent Application No. 63/170,155, titled Aerosol Delivery Device, filed on Apr. 2, 2021, each of which is incorporated herein in its entirety by reference.

FIELD OF THE DISCLOSURE

The present disclosure relates to aerosol delivery devices and systems, such as smoking articles; and more particularly, to aerosol delivery devices and systems that utilize heat sources, such as combustible carbon-based ignition sources, for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles may be made or derived from tobacco, or those articles may be characterized as otherwise incorporating tobacco for human consumption, and which may be capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable and/or replaceable components.

BRIEF SUMMARY

In various implementations, the present disclosure relates to aerosol delivery devices and holders for use with removable and replaceable cartridges. The present disclosure includes, without limitation, the following example implementations:

Example Implementation 1: A holder for use with a removable substrate cartridge, the holder comprising a main body defining a proximal end and a distal end, the main body further providing an aerosol passageway that extends through at least a portion of the main body, and a heat sink portion, wherein at least part of a receiving chamber is located in the heat sink portion, and wherein the heat sink portion is configured to dissipate heat from a substrate cartridge.

Example Implementation 2: The holder of Example Implementation 1, or any combination of preceding example implementations, wherein the heat sink portion comprises heat sink walls that define a plurality of open channels, and wherein the plurality of open channels substantially surround the receiving chamber.

Example Implementation 3: The holder of any of Example Implementations 1-2, or any combination of preceding example implementations, wherein the heat sink portion comprises heat sink walls that define a plurality of cavities, and wherein the plurality of cavities substantially surround the receiving chamber.

Example Implementation 4: The holder of any of Example Implementations 1-3, or any combination of preceding example implementations, wherein the main body further comprises at least one heat release feature comprising at least one opening located proximate the distal end thereof.

Example Implementation 5: The holder of any of Example Implementations 1-4, or any combination of preceding example implementations, further comprising a cartridge retention assembly, and a sliding assembly at least a portion of which is located within the main body, the sliding assembly including the heat sink portion, wherein the sliding assembly is configured to slide relative to the main body to and from at least: a loading position, wherein the cartridge retention assembly is configured to receive a substrate cartridge, and a use position, wherein the cartridge retention assembly is configured to retain a substrate cartridge.

Example Implementation 6: The holder of any of Example Implementations 1-5, or any combination of preceding example implementations, wherein in the loading position, the cartridge retention assembly is configured to retain a substrate cartridge.

Example Implementation 7: The holder of any of Example Implementations 1-6, or any combination of preceding example implementations, wherein the sliding assembly is further configured to slide relative to the main body to and from a releasing position, wherein in the releasing position, the cartridge retention assembly does not retain a substrate cartridge.

Example Implementation 8: The holder of any of Example Implementations 1-7, or any combination of preceding example implementations, wherein the sliding assembly further comprises a carrier that includes the heat sink portion and a button feature configured to be manually operated by a user to slide the sliding assembly.

Example Implementation 9: The holder of any of Example Implementations 1-8, or any combination of preceding example implementations, wherein the main body further comprises an elongate aperture, and wherein the button extends through the aperture and is configured to slide therein.

Example Implementation 10: An aerosol delivery device comprising a removable cartridge comprising a substrate portion that includes a substrate material having an aerosol precursor composition configured to form an aerosol upon application of heat thereto, and a holder comprising a main body defining a proximal end and a distal end, the main body further providing an aerosol passageway that extends through at least a portion of the main body, and a heat sink portion, wherein at least part of a receiving chamber is located in the heat sink portion, and wherein the heat sink portion is configured to dissipate heat from the cartridge.

Example Implementation 11: The aerosol delivery device of Example Implementation 10, or any combination of preceding example implementations, wherein the heat sink portion comprises heat sink walls that define a plurality of open channels, and wherein the plurality of open channels substantially surround the receiving chamber.

Example Implementation 12: The aerosol delivery device of any of Example Implementations 10-11, or any combination of preceding example implementations, wherein the heat sink portion comprises heat sink walls that define a plurality of cavities, and wherein the plurality of cavities substantially surround the receiving chamber.

Example Implementation 13: The aerosol delivery device of any of Example Implementations 10-12, or any combination of preceding example implementations, wherein the main body further comprises at least one heat release feature comprising at least one opening located proximate the distal end thereof.

Example Implementation 14: The aerosol delivery device of any of Example Implementations 10-13, or any combination of preceding example implementations, further comprising a cartridge retention assembly, and a sliding assembly at least a portion of which is located within the main body, the sliding assembly including the heat sink portion, wherein the sliding assembly is configured to slide relative to the main body to and from at least: a loading position, wherein the cartridge retention assembly is configured to receive the cartridge, and a use position, wherein the cartridge retention assembly is configured to retain the cartridge.

Example Implementation 15: The aerosol delivery device of any of Example Implementations 10-14, or any combination of preceding example implementations, wherein in the loading position, the cartridge retention assembly is configured to retain the cartridge.

Example Implementation 16: The aerosol delivery device of any of Example Implementations 10-15, or any combination of preceding example implementations, wherein the sliding assembly is further configured to slide relative to the main body to and from a releasing position, wherein in the releasing position, the cartridge retention assembly does not retain the cartridge.

Example Implementation 17: The aerosol delivery device of any of Example Implementations 10-16, or any combination of preceding example implementations, wherein the sliding assembly further comprises a carrier that includes the heat sink portion and a button feature configured to be manually operated by a user to slide the sliding assembly.

Example Implementation 18: The aerosol delivery device of any of Example Implementations 10-17, or any combination of preceding example implementations, wherein the main body further comprises an elongate aperture, and wherein the button extends through the aperture and is configured to slide therein.

Example Implementation 19: The aerosol delivery device of any of Example Implementations 10-18, or any combination of preceding example implementations, wherein the cartridge further comprises a heat portion including a heat source configured to generate heat.

Example Implementation 20: The aerosol delivery device of any of Example Implementations 10-19, or any combination of preceding example implementations, wherein the substrate portion is disposed proximate the heat source.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1:
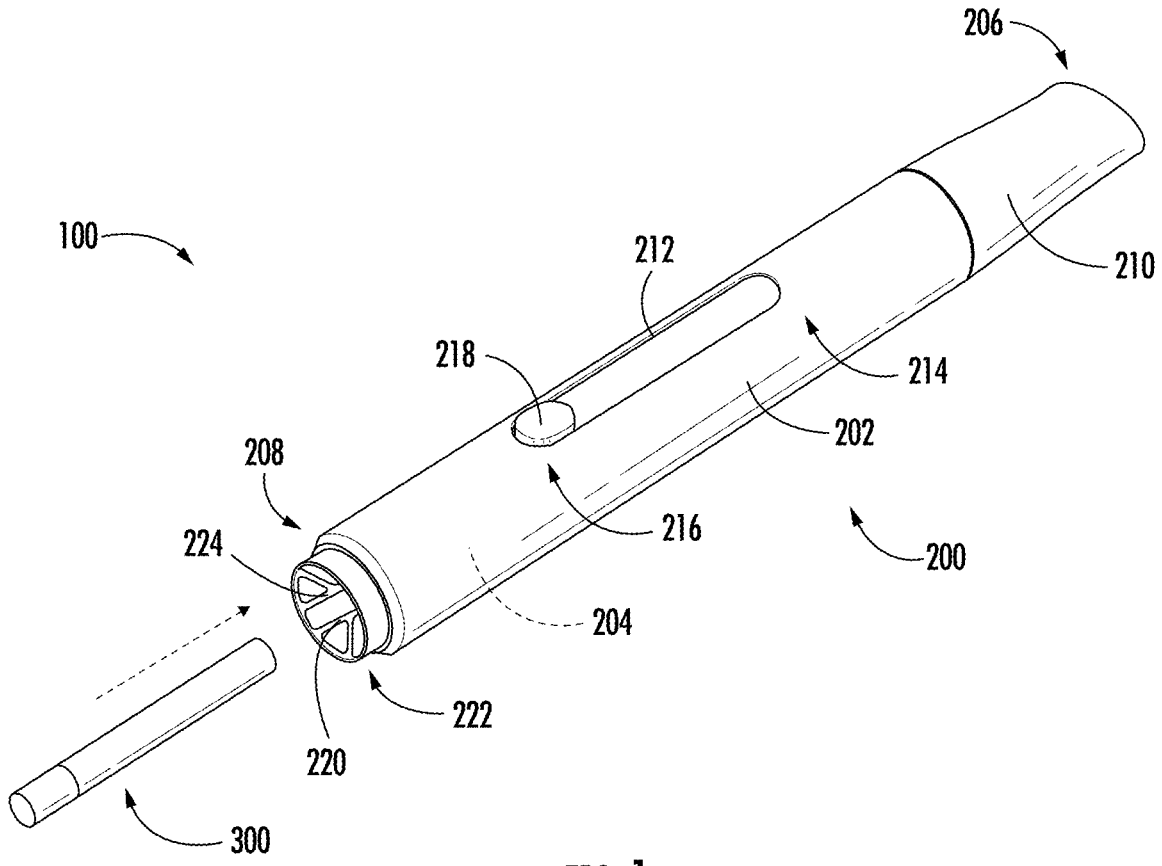
Figure 2:
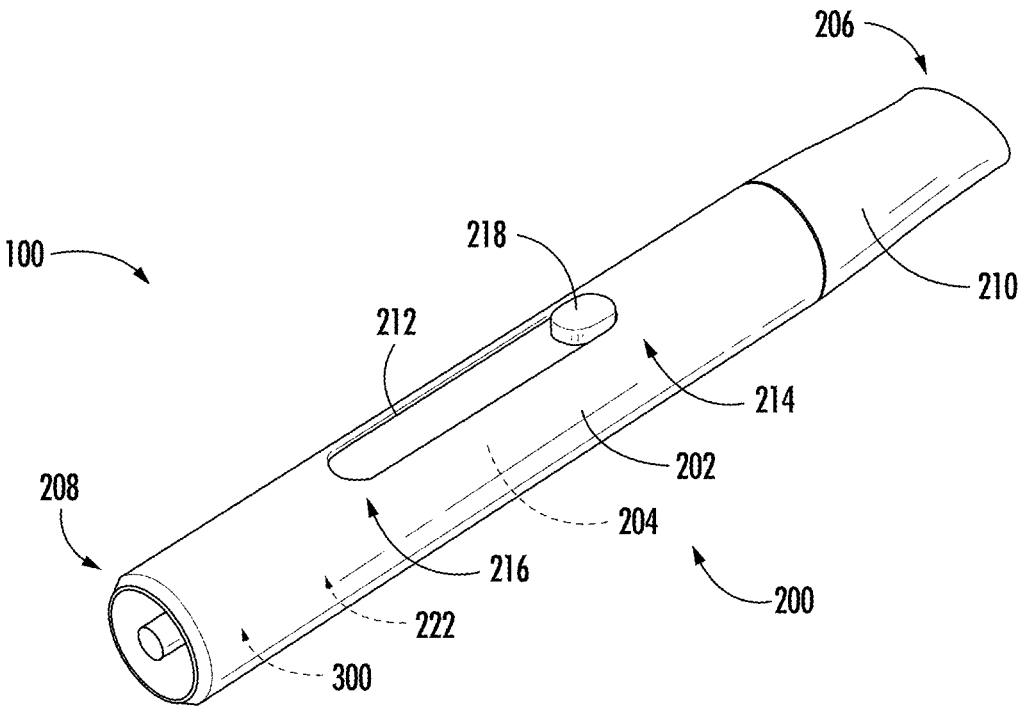
Figure 3:
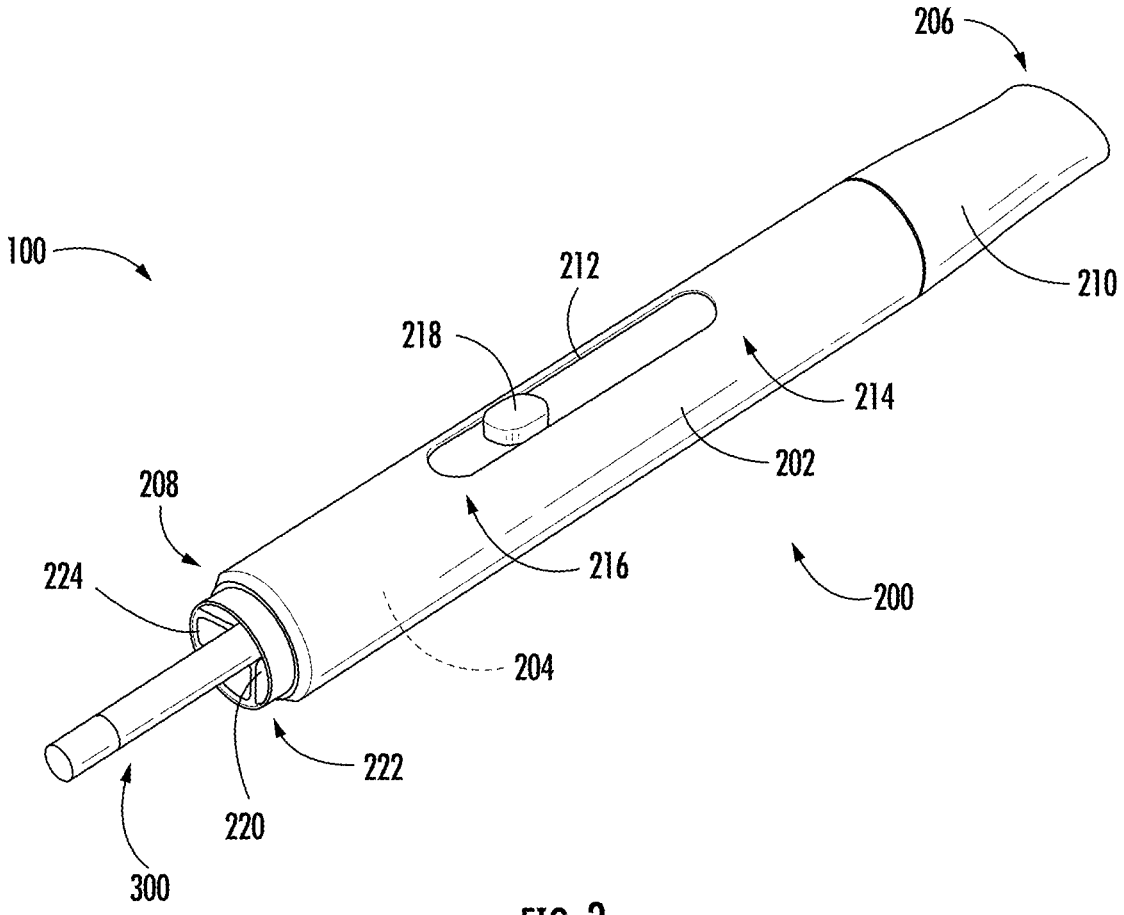
Figure 4:
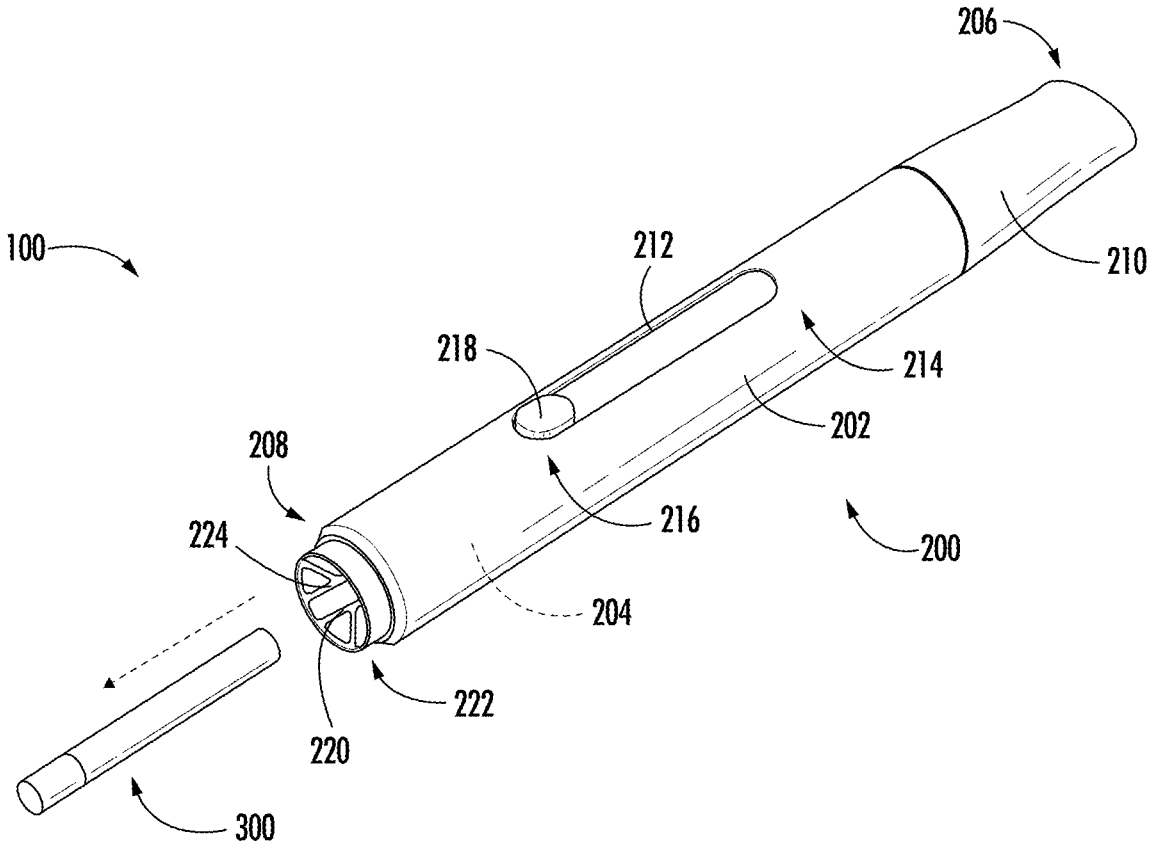
Figure 5:
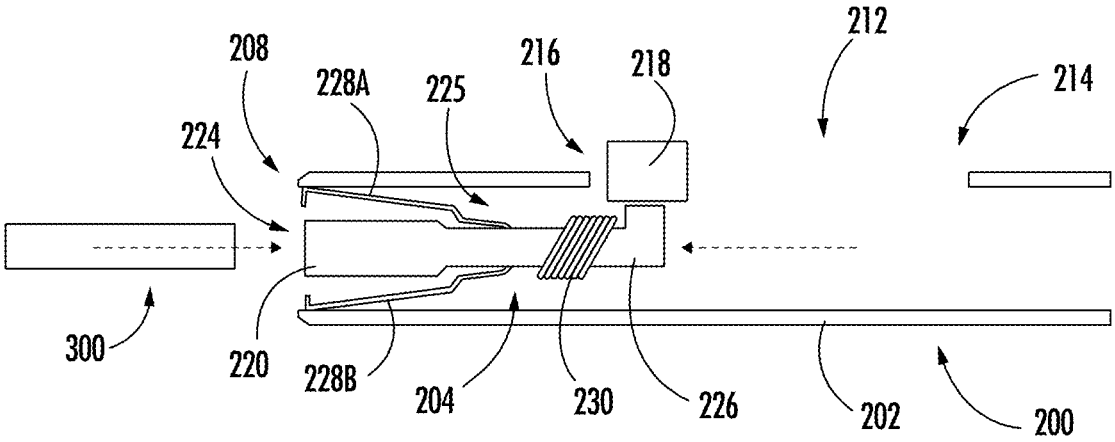
Figure 6:
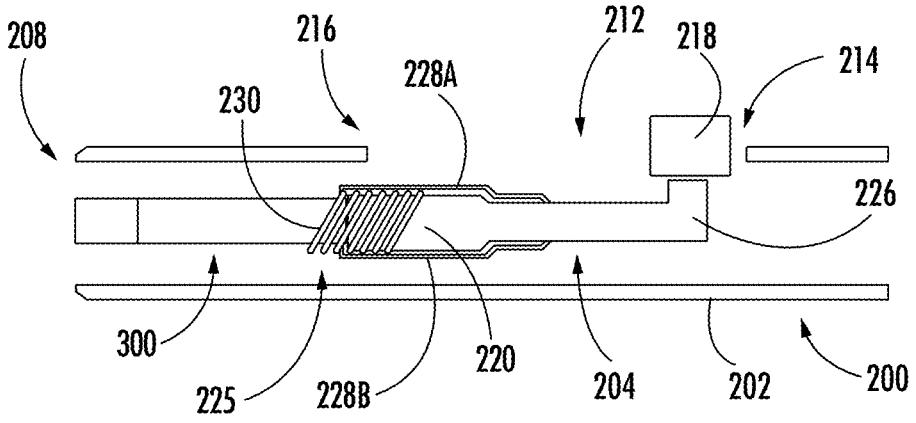
Figure 7:
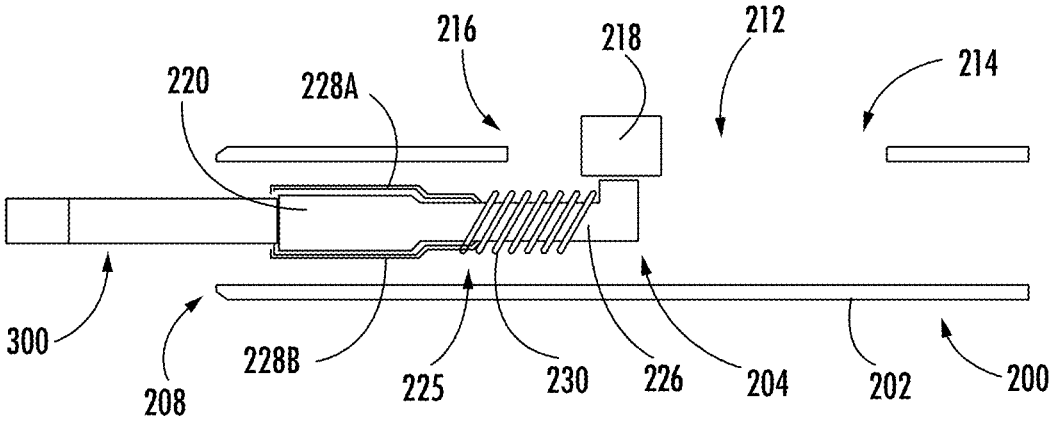
Figure 8:
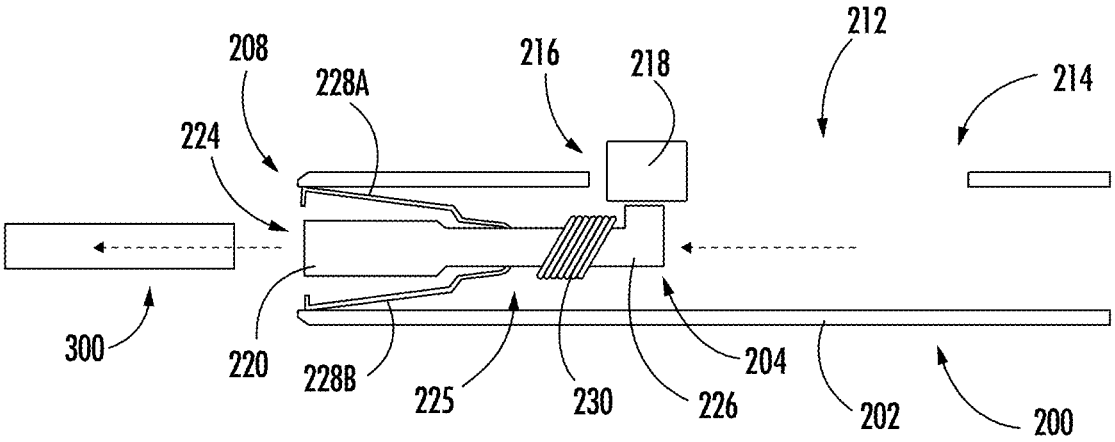
Figure 9:
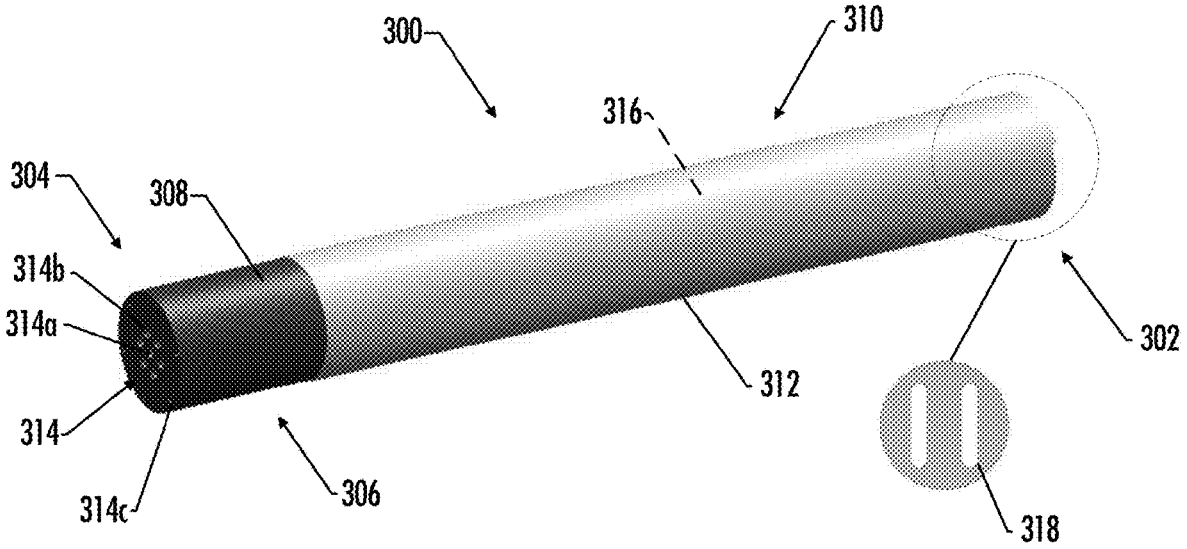
Figure 10:
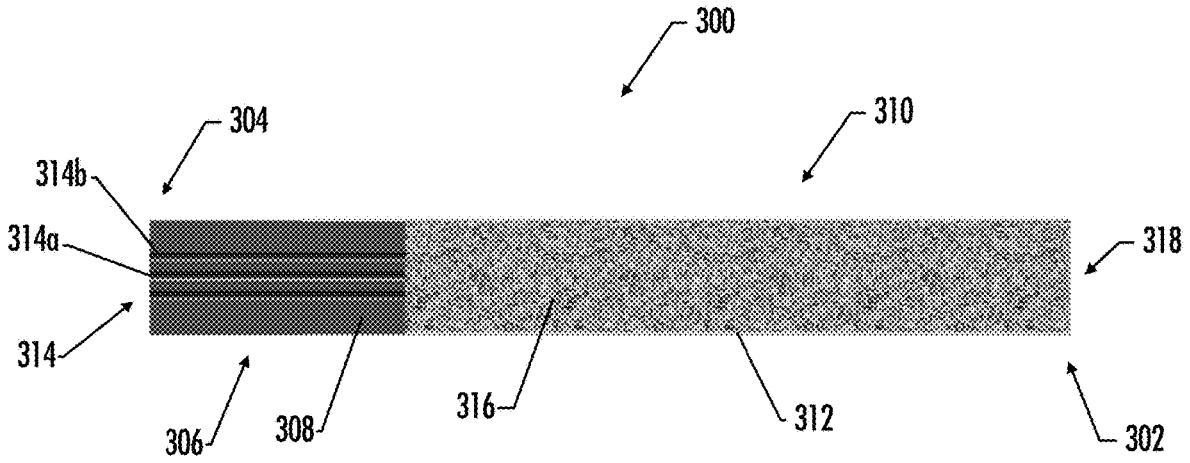
Figure 11A:
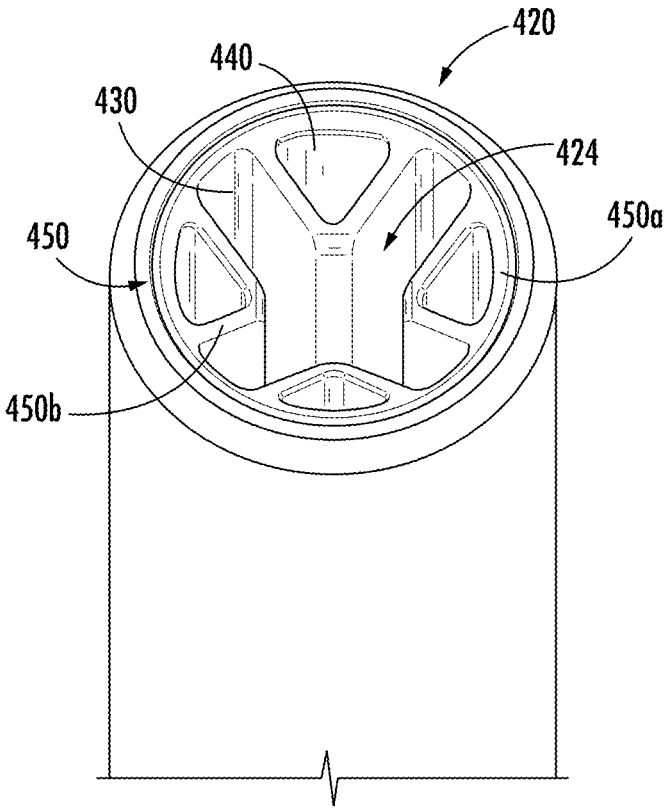
Figure 11B:
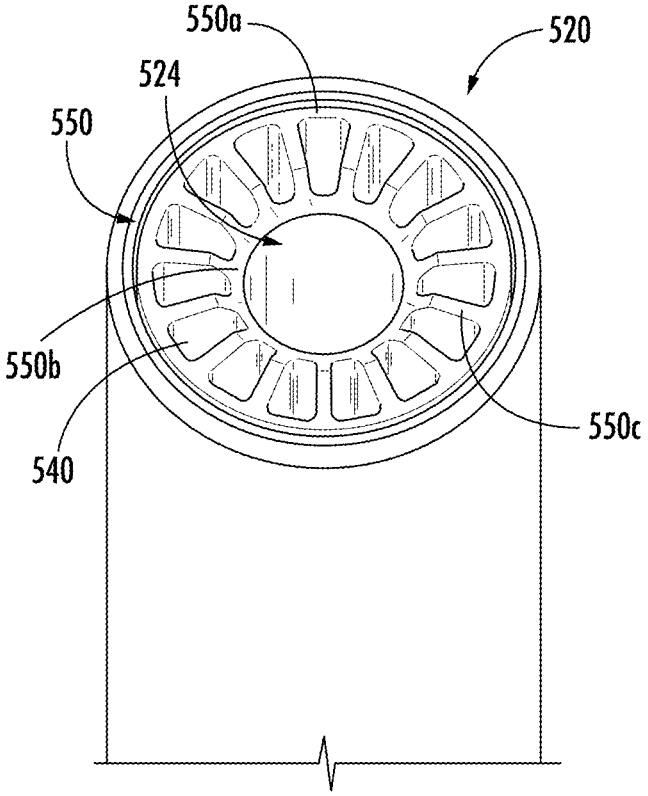
Figure 12:
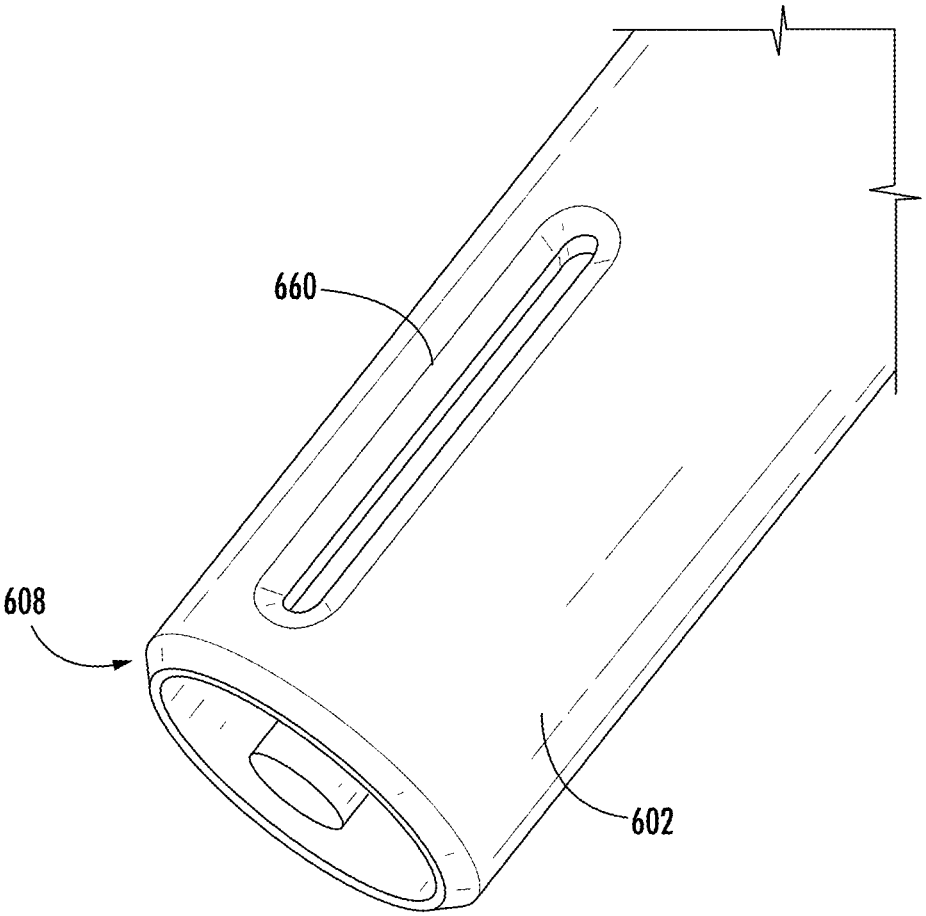
Figure 13:
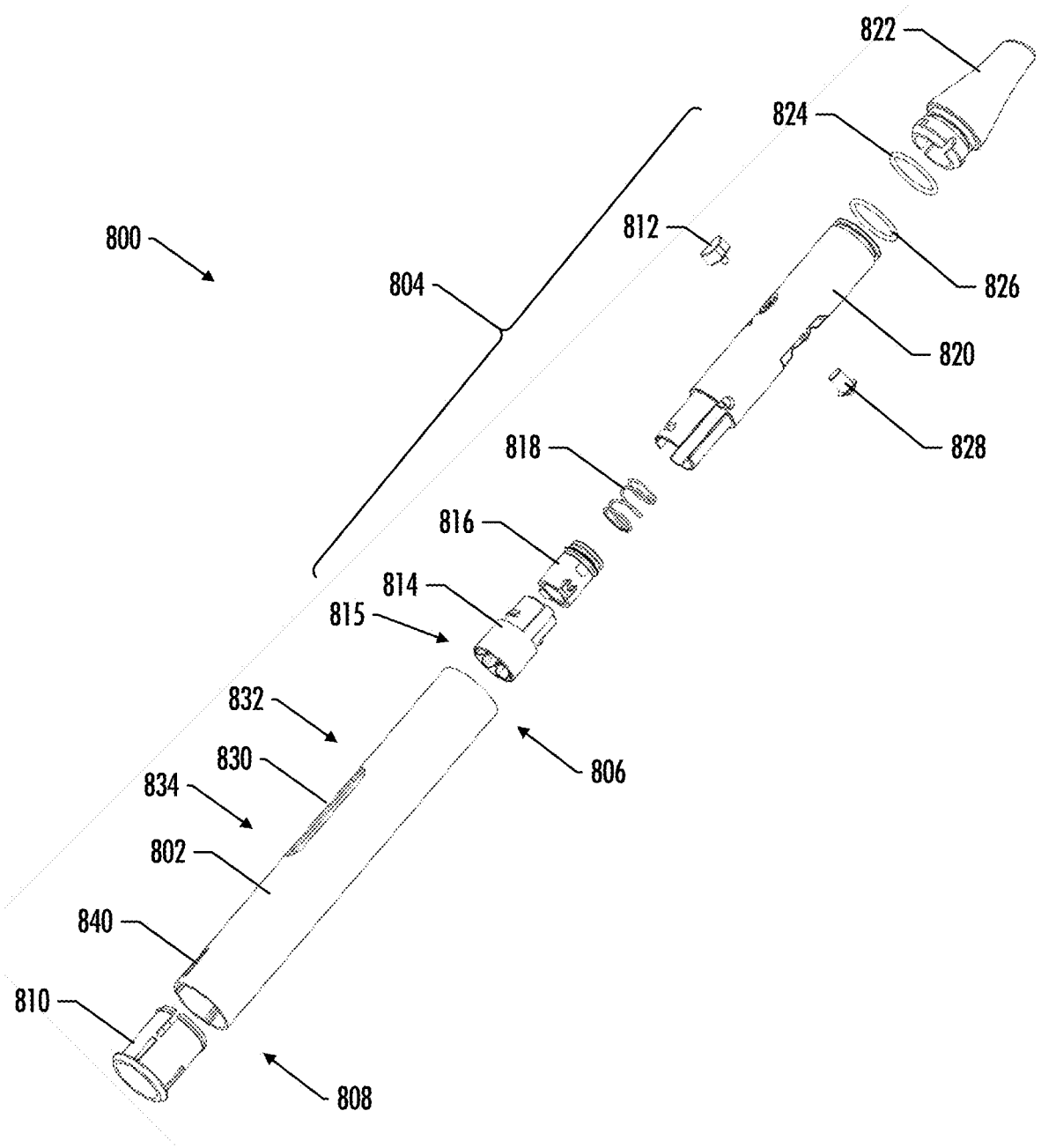
Figure 14:
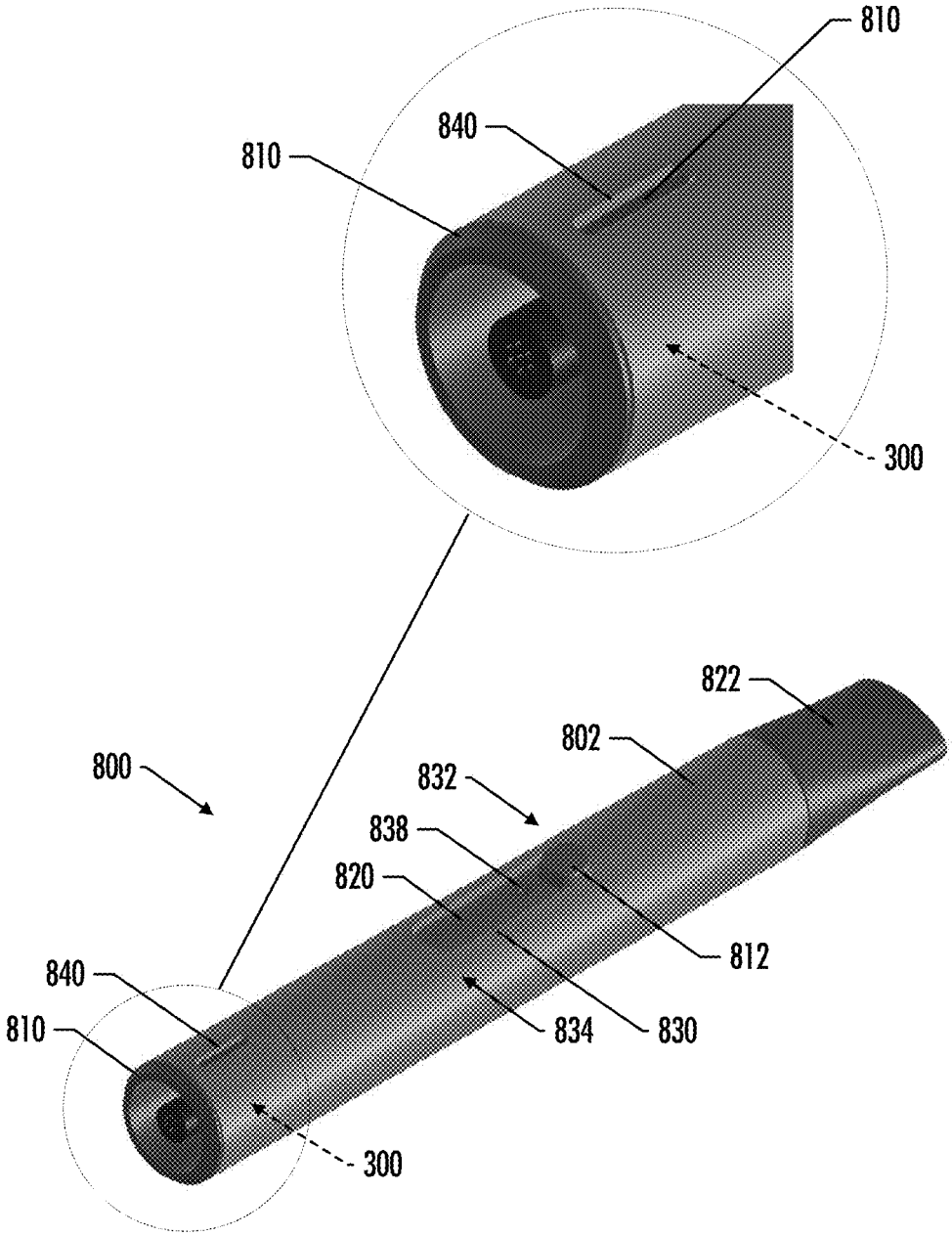
Figure 15A:
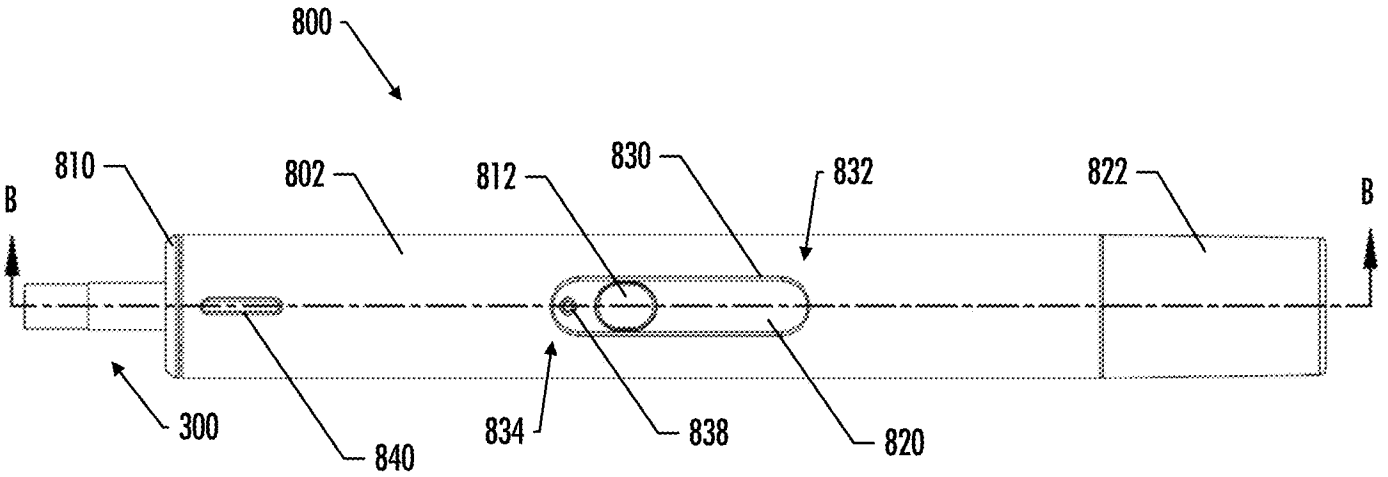
Figure 15B:
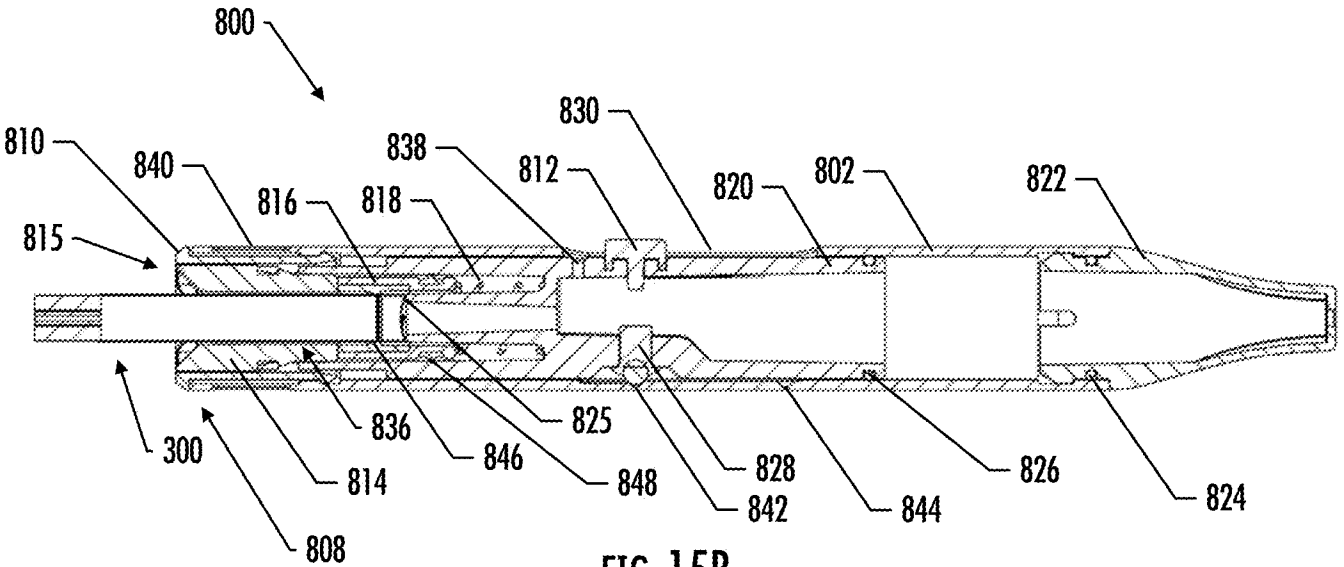
Figure 16A:
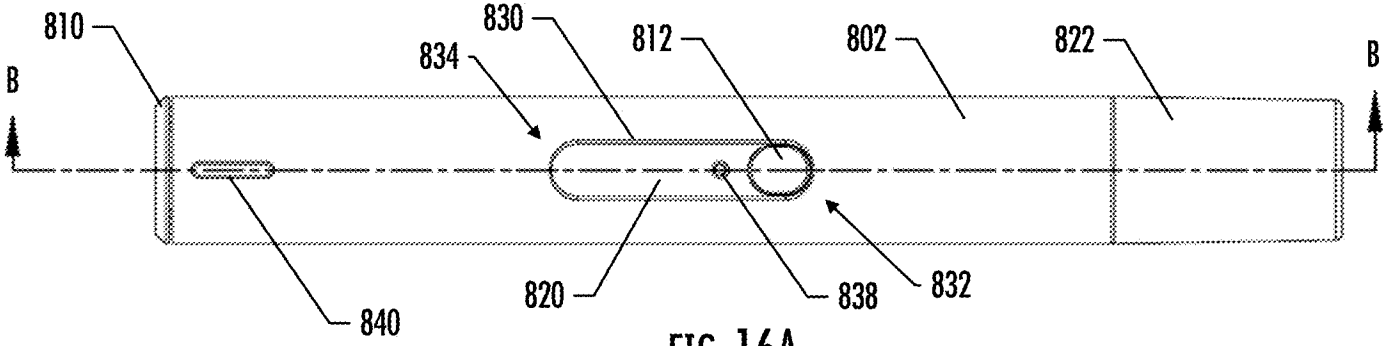
Figure 16B:
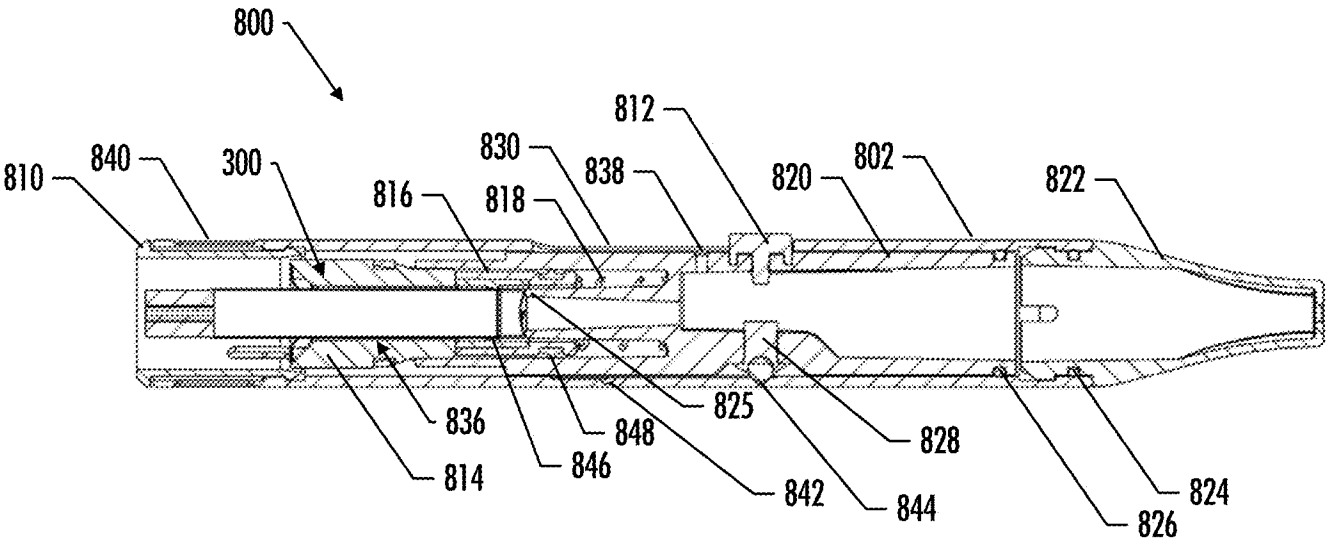
Figure 17A:
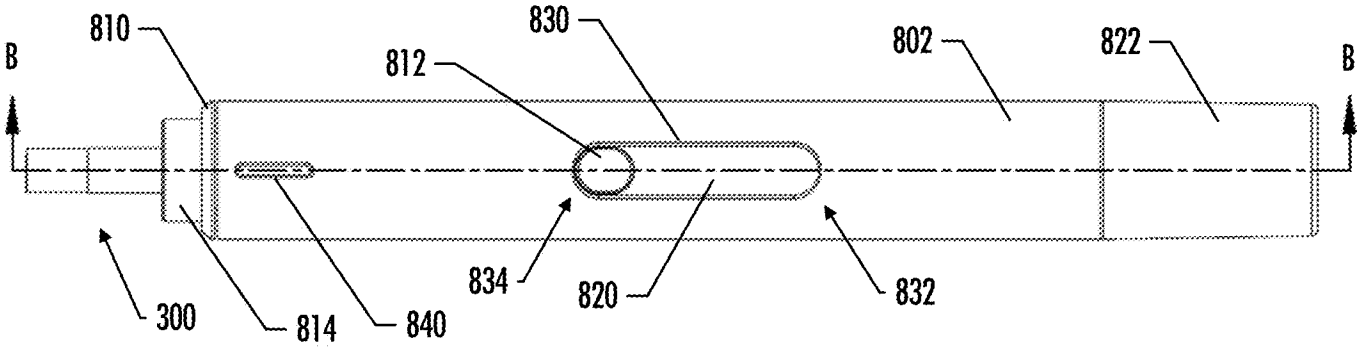
Figure 17B:
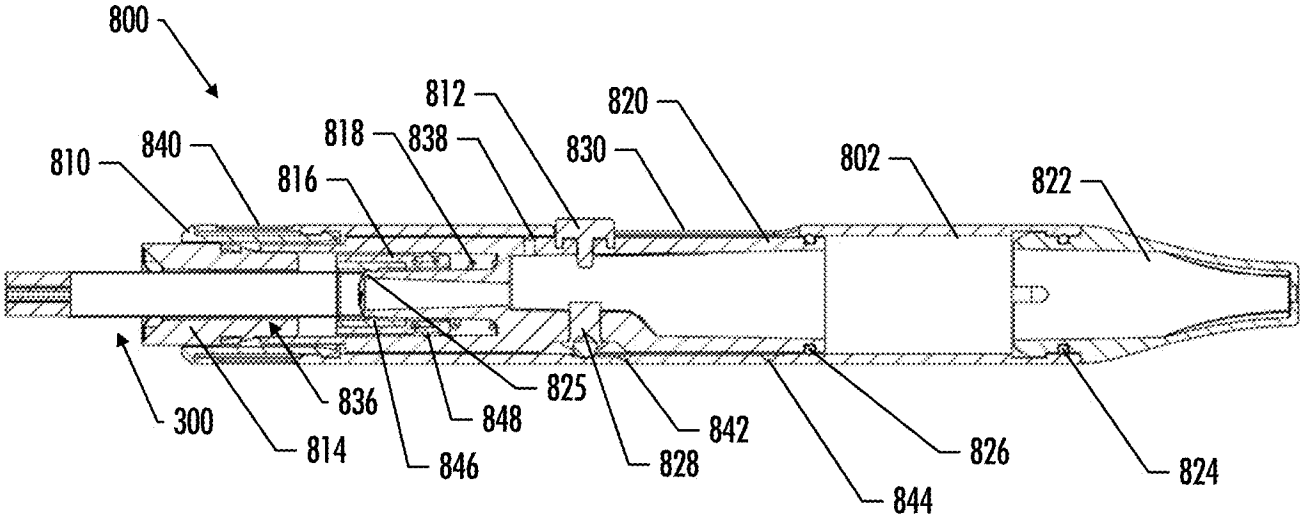
Figure 18:
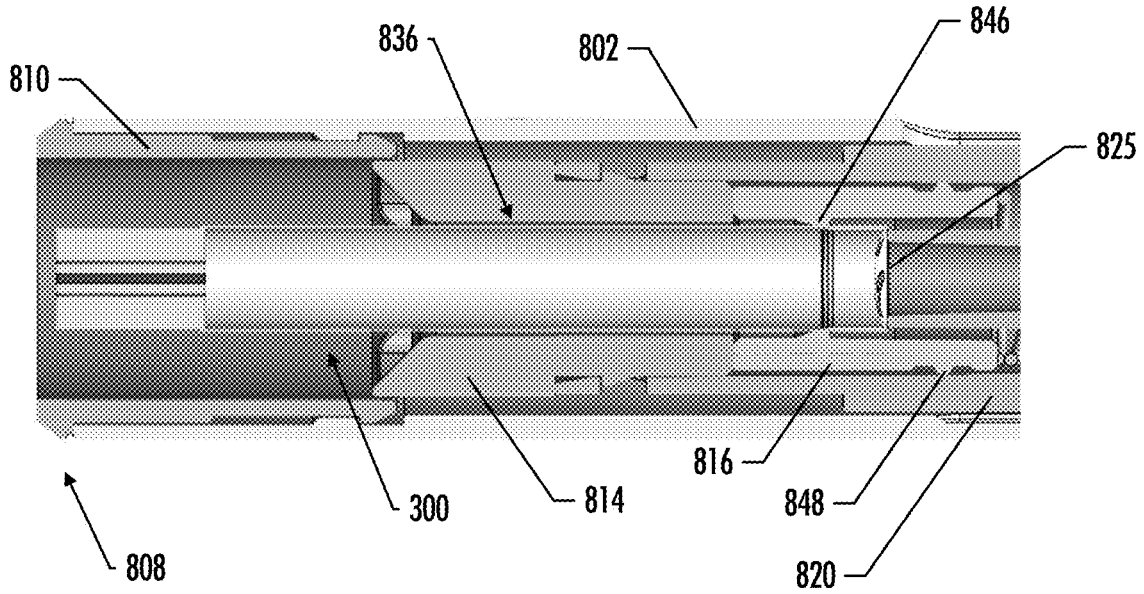
Figure 19:
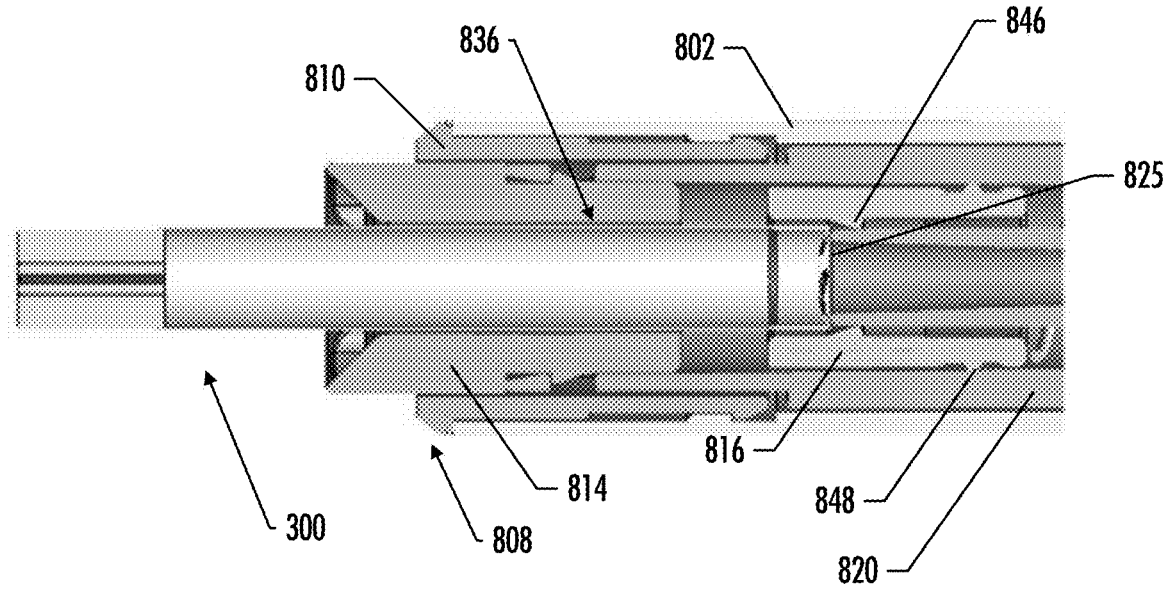
Figure 20:
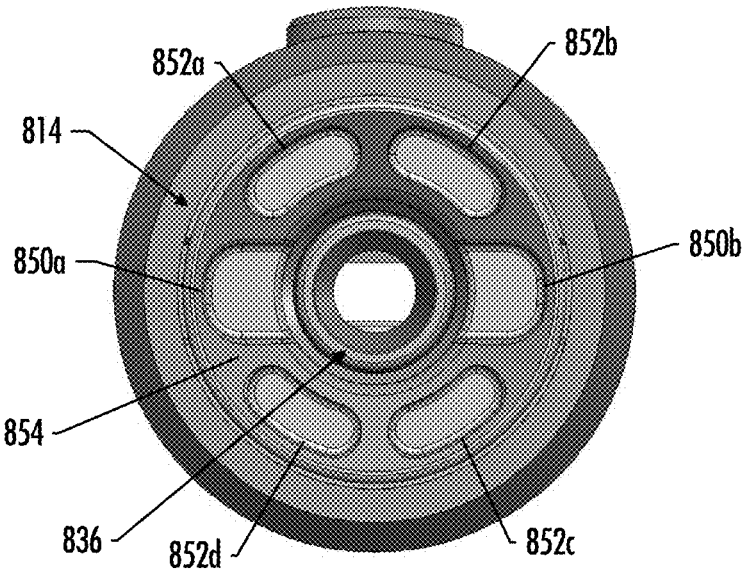
Figure 21:
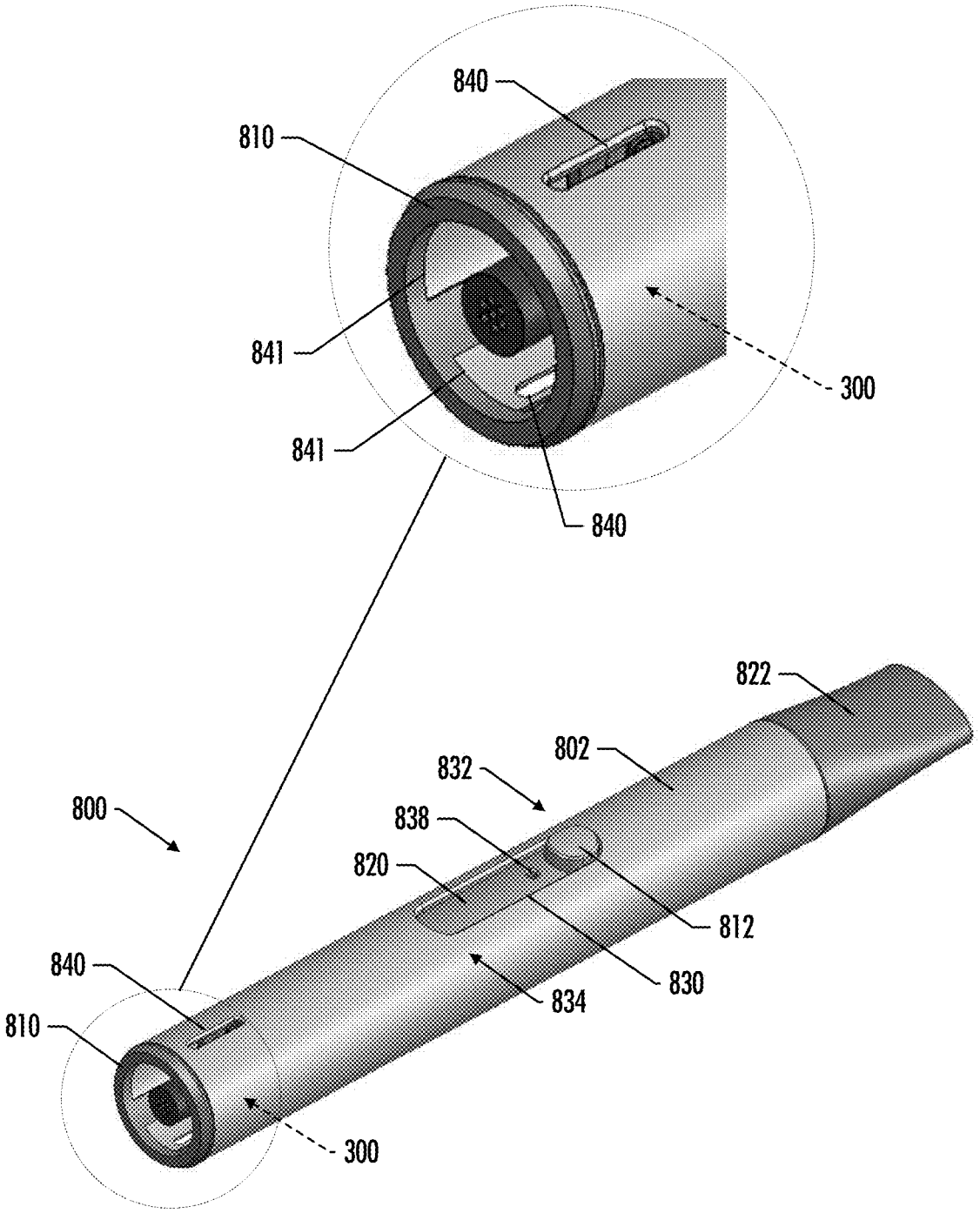

Having thus described the disclosure in the foregoing general terms, reference will now be made to the accompanying drawings, which are not necessarily drawn to scale, and wherein:

FIG. 1 illustrates a perspective view of a holder and a removable cartridge in a loading position, according to one implementation of the present disclosure;

FIG. 2 illustrates a perspective view of a holder and a removable cartridge in a use position, according to one implementation of the present disclosure;

FIG. 3 illustrates a perspective view of a holder and a removable cartridge in a lighting position, according to one implementation of the present disclosure;

FIG. 4 illustrates a perspective view of a holder and a removable cartridge in a releasing position, according to one implementation of the present disclosure;

FIG. 5 illustrates a schematic view of a portion of a holder and a portion of a removable cartridge in a loading position, according to one implementation of the present disclosure;

FIG. 6 illustrates a schematic view of a portion of a holder and a portion of a removable cartridge in a use position, according to one implementation of the present disclosure;

FIG. 7 illustrates a schematic view of a portion of a holder and a removable cartridge in a lighting position, according to one implementation of the present disclosure;

FIG. 8 illustrates a schematic view of a portion of a holder and a portion of a removable cartridge in a releasing position, according to one implementation of the present disclosure;

FIG. 9 illustrates a perspective view of a removable cartridge, according to one implementation of the present disclosure;

FIG. 10 illustrates a longitudinal cross-section view of a removable cartridge, according to one implementation of the present disclosure;

FIG. 11A illustrates a heat sink portion of a holder, according to one implementation of the present disclosure;

FIG. 11B illustrates a heat sink portion of a holder, according to one implementation of the present disclosure;

FIG. 12 illustrates a heat release feature of a holder, according to one implementation of the present disclosure;

FIG. 13 illustrates an exploded perspective view of a holder of an aerosol delivery device, according to one implementation of the present disclosure;

FIG. 14 illustrates a perspective view of a holder and a removable cartridge, according to one implementation of the present disclosure;

FIG. 15A illustrates a top view of a holder and a removable cartridge in a loading position, according to one implementation of the present disclosure;

FIG. 15B illustrates a cross-section view of the holder and removable cartridge of FIG. 15A, according to one implementation of the present disclosure;

FIG. 16A illustrates a top view of a holder and a removable cartridge in a use position, according to one implementation of the present disclosure;

FIG. 16B illustrates a cross-section view of the holder and removable cartridge of FIG. 16A, according to one implementation of the present disclosure;

FIG. 17A illustrates a top view of a holder and a removable cartridge in a releasing position, according to one implementation of the present disclosure;

FIG. 17B illustrates a cross-section view of the holder and removable cartridge of FIG. 17A, according to one implementation of the present disclosure;

FIG. 18 illustrates a cross-section view of a distal end of a holder and removable cartridge in a use position, according to one implementation of the present disclosure;

FIG. 19 illustrates a cross-section view of a distal end of a holder and removable cartridge in a releasing position, according to one implementation of the present disclosure;

FIG. 20 illustrates an end view of a holder, according to one implementation of the present disclosure; and FIG. 21 illustrates a perspective view of a holder and a removable cartridge, according to one implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In some aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In some aspects, articles or devices characterized as smoking articles incorporate tobacco and/or components derived from tobacco.

As noted, aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that device much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Smoking articles of the present disclosure generally include a number of elements provided or contained within an enclosure of some sort, such as a housing, an outer wrap, or wrapping, a casing, a component, a module, a member, or the like. The overall design of the enclosure is variable, and the format or configuration of the enclosure that defines the overall size and shape of the smoking article is also variable. It may be desirable, in some aspects, that the overall design, size, and/or shape of the enclosure resembles that of a conventional cigarette or cigar. Typically, an enclosure resembling the shape of a cigarette or cigar comprises separable components, members, or the like that are engaged to form the enclosure. For example, such a smoking article may comprise, in some aspects, separable components that include a holder and a cartridge that includes an aerosol delivery component (such as, for example, a substrate material) and a heat source component. In various aspects, the heat source may be capable of generating heat to aerosolize a substrate material that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. In some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations aerosol precursor composition-loaded porous beads/powders (ceramics) may be used. In other implementations, rods/cylinders made of extruded slurry of ceramic powder and aerosol precursor composition may be used.

According to certain aspects of the present disclosure, it may be advantageous to provide an aerosol delivery device that is easy to use and that provides reusable and/or replaceable components. FIG. 1 illustrates such a device. In particular, FIG. 1 illustrates a perspective view of an aerosol delivery device 100 that includes a holder 200 and a removable cartridge 300, according to one implementation of the present disclosure. As shown in the figure, the holder 200 is configured to receive the removable cartridge 300. As will be described in more detail below, the holder 200 of the depicted implementation is configured to achieve one or more positions via actuation by a user. In the depicted implementation, the holder 200 comprises a main body 202 and a sliding assembly 204, wherein the main body 202 defines a proximal end 206 and a distal end 208, and the sliding assembly 204 is configured to slide relative to the main body 202. The depicted implementation also includes a mouthpiece portion 210, the proximal end of which defines the proximal end 206 of the main body 202.

In some implementations, the holder (or any components thereof) may be made of moldable plastic materials such as, for example, polycarbonate, polyethylene, acrylonitrile butadiene styrene (ABS), polyamide (Nylon), or polypropylene. In other implementations, the holder may be made of a different material, such as, for example, a different plastic material, a metal material (such as, but not limited to, stainless steel, aluminum, brass, copper, silver, gold, bronze, titanium, various alloys, etc), a graphite material, a glass material, a ceramic material, a natural material (such as, but not limited to, a wood material), a composite material, or any combinations thereof. In the depicted implementation, the mouthpiece portion 210 is separable from the remaining portion of the main body 202. In some implementations, the main body and mouthpiece portion are made of the same material. In other implementations, the main body and mouthpiece are made of different materials. In various implementations comprising a separable mouthpiece portion, the mouthpiece portion may be coupled to the main body in a variety of ways, including, for example, via one or more of a snap-fit, interference fit, screw thread, magnetic, and/or bayonet connection. In other implementations, the mouthpiece portion may be integral with the main body and thus may not be separable.

In the depicted implementation, the main body 202 includes an elongate aperture 212 that defines a proximal end 214 and a distal end 216, and that extends along a portion of the length of the main body 202. Additionally, the sliding assembly 204 of the depicted implementation includes a button 218, which is configured to extend through the aperture 212. As will be described in more detail below, the button 218 of the depicted implementation is configured to be manually operated by a user to slide the sliding assembly 204 relative to the main body 202. In the depicted implementation, the sliding assembly 204 includes a heat sink portion 220, which defines a distal end 222. The heat sink portion 220 of the depicted implementation also defines a cartridge receiving chamber 224, which is configured to receive the removable cartridge 300.

In various implementations, the sliding assembly is configured to slide relative to the main body to and from one or more positions. In some implementations, one of the positions may be a loading position. In the loading position, the holder is configured to receive a removable cartridge. FIG. 1 illustrates the holder 200 in a loading position. In the loading position of various implementations, the distal end of the heat sink portion may be located at any position relative to the distal end of the holder. In the loading position of some implementations, the distal end of the heat sink portion may be located at a position proximate the distal end of the main body. In the loading position illustrated in FIG. 1, the distal end 222 of the heat sink portion 220 is configured to extend past the distal end 208 of the main body 202. In the loading position of various implementations, the button of the sliding assembly may be positioned at any location in the elongate aperture. In the loading position illustrated in FIG. 1, the button 218 of the depicted implementation is configured to be positioned proximate the distal end 216 of the elongate aperture 212. In such manner, a user of the holder 200 of the depicted implementation may move the sliding assembly 204 into a loading position by sliding the button 218 within the elongate aperture 212 until it reaches the distal end 216 thereof. In various implementations, there may be one or more detent features that may temporarily locate the sliding assembly in one or more positions. For example, some implementations may include a detent feature that may temporarily locate the sliding assembly in the loading position.

As will be described in more detail below, the holder of the depicted implementations of the present invention also includes a cartridge retention assembly that is configured to retain a cartridge in the receiving chamber in one or more positions of the holder. In the depicted implementations, one or more retaining fingers may form part of the cartridge retention assembly. In other implementations, however, other retaining features may be used. For example, in some implementations one or more retention spheres may form part of a cartridge retention assembly. In other implementations, a cartridge retention assembly may comprise one or more resilient members. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets.

In various implementations, one or more components of a cartridge retention assembly may be made of any material, including for example, but not limited to, metal or plastic materials. For example, some implementations may include one or more components of a cartridge retention assembly that are made of a metal material such as, for example, stainless steel, aluminum, brass, copper, silver, gold, bronze, titanium, various alloys, etc. In some implementations, one or more components of a cartridge retention assembly may be made of a moldable plastic material such as, for example, polycarbonate, polyethylene, acrylonitrile butadiene styrene (ABS), polyamide (Nylon), or polypropylene. In some implementations, one or more components of a cartridge retention assembly may be made of a different material, such as, for example, a different plastic material, a different metal material, a graphite material, a glass material, a ceramic material, a natural material (such as, but not limited to, a wood material), a composite material, or any combinations thereof.

As noted above, the sliding assembly of various implementations is configured to slide relative to the main body to and from one or more positions. In some implementations, one of the positions may be a use position. In the use position, the sliding assembly is configured to position at least a portion of the cartridge inside the holder. In the use position, a user may draw on the mouthpiece portion of the holder in order to generate an aerosol from the cartridge. FIG. 2 illustrates a holder 200 in a use position. In the use position of some implementations, the distal end of the heat sink portion may be located at any position proximate the distal end of the holder. In the use position illustrated in FIG. 2, the distal end 222 of the heat sink 220 is configured to be located between the proximal end 206 and the distal end 208 of the main body 202. In the use position of various implementations, a cartridge may be received into the holder to varying degrees. For example, in the use position of some implementations, less than a half of the length of the cartridge may be located within the holder (e.g., less than 50%, less than 45%, less than 40%, less than 35%, less than 30%, less than 25%, less than 20%, less than 15%, less than 10%, less than 5%, etc.). In the use position of other implementations, approximately half of the length of the cartridge may be received into the holder. In the use position of other implementations, more than a half of the length of the cartridge may be received into the holder (e.g., more than 50%, more than 55%, more than 60%, more than 65%, more than 70%, more than 75%, more than 80%, more than 85%, more than 90%, more than 95%, etc.). In use position of the depicted implementation, the sliding assembly 204 is configured such that substantially the entire length of the cartridge 300 is located within of the holder 200. In the use position of various implementations, the button of the sliding assembly may be positioned at any location in the elongate aperture. In the use position illustrated in FIG. 2, the button 218 of the sliding assembly 204 is configured to be positioned proximate the proximal end 214 of the elongate aperture 212. In such manner, a user of the holder 200 of the depicted implementation may move the sliding assembly 204 into a use position by sliding the button 218 within the elongate aperture 212 until it reaches the proximal end 214 thereof. In various implementations, there may be one or more detent features that may temporarily locate the sliding assembly in one or more positions. For example, some implementations may include a detent feature that may temporarily locate the sliding assembly in the use position.

As noted above, the sliding assembly of various implementations is configured to slide relative to the main body to and from one or more positions. In some implementations, one of the positions may be a lighting position. In the lighting position, the holder is configured to position a portion of the cartridge within the holder, and a portion of the cartridge outside of the holder. FIG. 3 illustrates the holder 200 in a lighting position. In the lighting position of various implementations, the distal end of the heat sink portion may be located at any position relative to the distal end of the holder. In the lighting position of some implementations, the distal end of the heat sink portion may be located at a position proximate the distal end of the main body. In the lighting position of FIG. 3, the distal end 222 of the heat sink portion 220 is configured to be substantially aligned with the distal end 208 of the main body 202. In the lighting position of various implementations, a cartridge may extend beyond the distal end of the holder to varying degrees. In the lighting position of some implementations, less than half of the length of cartridge may extend beyond the distal end of the holder. In the lighting position of other implementations, more than half of the length of the cartridge may extend beyond the distal end of the holder. In the lighting position of the depicted implementation, the holder 200 is configured such that more than half of the length of the cartridge 300 extends beyond the distal end 208 of the holder 200. In the lighting position of various implementations, the button of the sliding assembly may be positioned at any location in the elongate aperture. In the lighting position of FIG. 3, the button 218 of the sliding assembly 204 is configured to be positioned between the proximal end 214 and distal end 216 of the aperture 212. In such manner, a user of the holder 200 of the depicted implementation may move the sliding assembly 204 into a lighting position from the loading position or the use position by sliding the button 218 within the elongate aperture 212 to a position between the proximal end 214 and the distal end 216 thereof. In various implementations, there may be one or more detent features that may temporarily locate the sliding assembly in one or more positions. For example, some implementations may include a detent feature that may temporarily locate the sliding assembly in the lighting position.

As noted above, the sliding assembly of various implementations is configured to slide relative to the main body to and from one or more positions. In some implementations, one of the positions may be a releasing (or ejecting) position. In the releasing position, the holder is configured to release a removable cartridge. FIG. 4 illustrates the holder 200 in a releasing position. In the releasing position of various implementations, the distal end of the heat sink portion may be located at any position relative to the distal end of the holder. In the releasing position of FIG. 4, the distal end 222 of the heat sink 220 is configured to extend past the distal end 208 of the main body 202. In the releasing position of various implementations, the button of the sliding assembly may be positioned at any location in the elongate aperture. In the releasing position of FIG. 4, the button 218 of the sliding assembly 204 is configured to be positioned proximate the distal end 216 of the elongate aperture 212. In such manner, a user of the holder 200 of the depicted implementation may move the sliding assembly 204 into a releasing position by sliding the button 218 within the elongate aperture 212 until it reaches the distal end 216 thereof. In various implementations, there may be one or more detent features that may temporarily locate the sliding assembly in one or more positions. For example, some implementations may include a detent feature that may temporarily locate the sliding assembly in the releasing position.

In some implementations, the loading position and the releasing position may represent substantially the same position. For example, in some such implementations, the location of the sliding assembly 204 with respect to the main body 202, and the locations of the button 218 with respect to the elongate aperture 212, are substantially the same in the loading position depicted in FIG. 1 and the releasing position depicted in FIG. 4. It should be noted, however, that the loading and releasing positions of other implementations may represent unique positions. In such a manner, the location of the sliding assembly with respect to the main body of some implementations, and/or the location of the button with respect to the elongate aperture of some implementations, may be different.

It should be noted that in some implementations of the present disclosure, a sliding assembly may include further movements in addition to sliding into and out of the of the main body. For example, in some implementations a sliding assembly may rotate while moving (or for a portion of its movement) into and out of the main body. In some of such implementations, movement of the sliding assembly may occur via a button manually operated by a user. In other of such implementations, movement of the sliding assembly may occur by rotating a portion of the holder, such as, for example, by rotating the main body and/or the mouthpiece portion and/or another component of the holder. In additional implementations, rotational movement may occur in other ways. In still other implementations, other movements are possible.

As noted above, in various implementations, the holder of the present disclosure includes a cartridge retention assembly. In some positions, the cartridge retention assembly is configured to retain a removable cartridge. In other positions, the cartridge retention assembly is configured to allow a cartridge to be loaded and/or to be released. FIG. 5 illustrates a schematic view of a portion of a removable cartridge and a portion of a holder, according to one implementation of the present disclosure. In particular, FIG. 5 illustrates a portion of a removable cartridge 300 and a holder 200, shown in a loading position. In the depicted implementation, the sliding assembly 204 comprises a carrier 226 that includes the heat sink portion 220 on one end, and the button 218 on another end. In some implementations, the carrier, the heat sink portion, and the button may be integral in a common part. In other implementations, one or more of these components may comprise separate parts that are connected or affixed to each other.

In the depicted implementation, the sliding assembly 204 also includes a cartridge retention assembly 225. In various implementations, the cartridge retention assembly may comprise any one feature, or any combination of features, configured to retain a cartridge. In the depicted implementation, the cartridge retention assembly 225 comprises at least one retaining finger 228 and at least one biasing feature 230. In particular, the cartridge retention assembly 225 of the depicted implementation comprises a pair of opposing retaining FIGS. 228A, 228B, and a single biasing feature 230. In the depicted implementation, the retaining fingers 228A, 228B comprise metal clips that include turned ends configured (in one or more positions) to engage the cartridge 300. In the depicted implementation, the biasing feature 230 comprises a metal spring that is configured to bias (or resist movement of) the sliding assembly 204 in one or more positions. In other implementations, the cartridge retention assembly may comprise any feature configured to engage a cartridge, and the biasing feature may comprise any feature configured to bias (or resist movement of) the sliding assembly in one or more positions. In various implementations, the component(s) of the cartridge retention feature may be made of any material or any combination of materials. In the depicted implementation, the biasing feature 230 is part of the cartridge retention assembly 225, although in other implementations the biasing feature may be separate from the cartridge retention assembly. In the depicted implementation, the cartridge retention assembly 225 is part of the sliding assembly 204, although in other implementations one or more components of the cartridge retention assembly (or the entire cartridge retention assembly) may be separate from the sliding assembly.

In the depicted implementation, movement of the button 218 causes the carrier 226 and heat sink portion 220 to move in the same direction. As such, in the loading position of the depicted implementation (as shown in FIG. 5), the button 218 is positioned proximate the distal end 216 of the elongate aperture 212 of the holder 200, and the heat sink portion 220 is positioned proximate the distal end 208 of the holder 200. In the depicted implementation, the position of the sliding assembly 204 also affects the state of the cartridge retention assembly 225. As such, in the loading position of the depicted implementation, the cartridge retention assembly 225 does not retain the cartridge 300, but rather, the cartridge receiving chamber 224 is configured to receive the cartridge 300. In particular, in the loading position of the depicted implementation, the retaining fingers 228A, 228B are extended (or pivoted) away from the cartridge receiving chamber 224 such that the cartridge receiving chamber 224 is unobstructed and is configured to receive the cartridge 300. In the depicted implementation, movement of the retaining FIGS. 228A, 228B into the loading position occurs via a cam feature (not shown) that forces, or allows, the retaining fingers 228A, 228B to move outward and away from the cartridge receiving chamber 224. In other implementations, however, movement of the retaining figures may occur in other ways, including, for example, via a spring feature. In the depicted implementation, a distal end of the biasing feature 230 is anchored (such as, for example, to one or more components of the main body of the holder) so that movement of the sliding assembly 204 in the distal direction may compress the biasing feature 230. As such, in the loading position of the depicted implementation, the biasing feature 230 is in a compressed state. Thus, in the depicted implementation, the biasing feature 300 biases the sliding assembly 204 away from the loading position. In such a manner, a user of the holder 200 of the depicted implementation may hold the button 218 in the loading position in order to load a cartridge 300 into the cartridge receiving chamber 224. It should be noted that in other implementations, the biasing feature may bias the sliding assembly toward the loading position. In still other implementations, there need not be a biasing feature, or the biasing feature may not affect the loading position. In various implementations, there may be one or more detent features that may temporarily locate the sliding assembly in one or more positions. For example, some implementations may include a detent feature that may temporarily locate the sliding assembly in the loading position.

FIG. 6 illustrates a schematic view of a removable cartridge and a portion of a holder in a use position, according to one implementation of the present disclosure. In particular, FIG. 6 illustrates a portion of the holder 200 and the cartridge 300 in the use position. In the use position of the depicted implementation, the button 218 is positioned proximate the proximal end 214 of the elongate aperture 212 of the holder 200, and the heat sink portion 220 is positioned within the holder 200. In addition, in the use position of the depicted implementation, the sliding assembly 204 is configured such that substantially the entire length of the cartridge 300 is located within the holder 200. It should be noted that in the use position of other implementations, a portion of the cartridge may extend outside of the holder 200.

In the use position of the depicted implementation, the cartridge retention assembly 225 retains the cartridge 300 in the cartridge receiving chamber 224. In particular, in the use position of the depicted implementation, the retaining fingers 228A, 228B are retracted (or pivoted) toward the cartridge 300 such that the retaining FIGS. 228A, 228B engage a portion of an exterior surface of the cartridge 300, thus retaining the cartridge 300 in the cartridge receiving chamber 224. In the depicted implementation, movement of the retaining FIGS. 228A, 228B into the use position occurs via a cam feature (not shown) that forces, or allows, the retaining fingers 228A, 228B to move inward to engage the cartridge 300. In other implementations, movement of the retaining figures may occur in other ways. In the use position of the depicted implementation, the biasing feature 230 is in an uncompressed state. In the use position of other implementations, the biasing feature may be in a compressed state. In various implementations, there may be one or more detent features that may temporarily locate the sliding assembly in one or more positions. For example, some implementations may include a detent feature that may temporarily locate the sliding assembly in the use position.

FIG. 7 illustrates a schematic view of a removable cartridge and a portion of a holder in a lighting position, according to one implementation of the present disclosure. In particular, FIG. 7 illustrates the holder 200 and the cartridge 300 in the lighting position. In the lighting position of the depicted implementation, the button 218 is positioned between the proximal end 214 and the distal end 216 of the elongate aperture 212 of the holder 200, the heat sink portion 220 is positioned within the holder 200, and a portion of the cartridge 300 extends beyond the distal end 208 of the holder 200. As noted above, in various implementations, a cartridge may extend beyond the distal end of the holder to varying degrees in the lighting position. For example, in some implementations, less than half of the length of cartridge may extend beyond the distal end of the holder in the lighting position. In other implementations, more than half of the length of the cartridge may extend beyond the distal end of the holder in the use position. In the lighting position of the depicted implementation, the holder 200 is configured such that more than half of the length of the cartridge 300 extends beyond the distal end 208 of the holder 200.

In the lighting position of the depicted implementation, the cartridge retention assembly 225 retains the cartridge 300 in the cartridge receiving chamber 224. In particular, in the lighting position of the depicted implementation, the retaining fingers 228A, 228B are retracted (or pivoted) toward the cartridge 300 such that the retaining FIGS. 228A, 228B engage a portion of an exterior surface of the cartridge 300, thus retaining the cartridge 300 in the cartridge receiving chamber 224. In the depicted implementation, movement of the retaining FIGS. 226A, 226B into the lighting position occurs via a cam feature (not shown) that forces, or allows, the retaining fingers 228A, 228B to move inward to engage the cartridge 300. In other implementations, movement of the retaining figures may occur in other ways. In the lighting position of the depicted implementation, the biasing feature 230 is in an uncompressed state. In the lighting position of other implementations, the biasing feature may be in a compressed state. In various implementations, there may be one or more detent features that may temporarily locate the sliding assembly in one or more positions. For example, some implementations may include a detent feature that may temporarily locate the sliding assembly in the lighting position.

FIG. 8 illustrates a schematic view of a removable cartridge and a portion of a holder in a releasing position, according to one implementation of the present disclosure. In particular, FIG. 8 illustrates a portion of the holder 200 and the cartridge 300 in the releasing position. In the releasing position of the depicted implementation, the button 218 is positioned proximate the distal end 216 of the elongate aperture 212 of the holder 200, and the heat sink portion 220 is positioned proximate the distal end 208 of the holder 200. In the depicted implementation, the position of the sliding assembly 204 also affects the state of the cartridge retention assembly 225. As such, in the releasing position of the depicted implementation, the cartridge retention assembly 225 does not retain the cartridge 300, but rather, the holder 200 is configured to release the cartridge 300. In particular, in the releasing position of the depicted implementation, the retaining fingers 226A, 226B are extended (or pivoted) away from the heat sink portion 220 such that the cartridge receiving chamber 224 is unobstructed and is configured to release the cartridge 300. In the depicted implementation, movement of the retaining FIGS. 226A, 226B into the releasing position occurs via a cam feature (not shown) that forces, or allows, the retaining fingers 228A, 228B to move outward and away from the cartridge receiving chamber 224. In other implementations, movement of the retaining figures may occur in other ways. In the depicted implementation, a distal end of the biasing feature 230 is anchored (such as, for example, to one or more components of the holder) such that movement of the sliding assembly 204 in the distal direction compresses the biasing feature 230 (as shown in the figure). As such, in the releasing position of the depicted implementation, the biasing feature 230 is in a compressed state. Thus, in the depicted implementation, the biasing feature 300 biases the sliding assembly 204 away from the releasing position. As such, a user of the holder 200 of the depicted implementation may hold the button 218 in the releasing position in order to load a cartridge 300 into the cartridge receiving chamber 224. It should be noted that in other implementations, the biasing feature may bias the sliding assembly toward the releasing position. In still other implementations, there need not be a biasing feature, or the biasing feature may not affect the releasing position. In various implementations, there may be one or more detent features that may temporarily locate the sliding assembly in one or more positions. For example, some implementations may include a detent feature that may temporarily locate the sliding assembly in the releasing position.

As noted above, in some implementations, the loading position and the releasing position may represent substantially the same position. It should be noted, however, that the loading and releasing positions of other implementations may represent unique positions. In such a manner, the position of the sliding assembly with respect to the main body of some implementations, and/or the position of the button with respect to the elongate aperture of some implementations, may be different. Some implementations may include additional features configured to facilitate ejecting the cartridge, including, for example, one or more additional biasing features.

When the holder is in the use position and the cartridge is received in the cartridge retention assembly, a draw by a user may cause air to flow through the cartridge for delivery to the user. In some implementations, air may enter the cartridge through the heat portion (e.g., the heat portion 306 as illustrated in FIGS. 9 and 10 and as described below). In other implementations (such as, for example, implementations in which the cartridge includes a nonporous barrier between the heat portion and the substrate material), air may enter the cartridge at some area downstream from the heat portion. In still other implementations, a portion of air may enter the cartridge through the heat portion and a portion of air may enter the cartridge at some area downstream from the heat portion. In some implementations, the first body portion and/or the second body portion may include one or more airflow passageways that substantially align with one or more airflow intake openings located downstream from the heat portion and that extend through the outer housing of the cartridge. For example, in the use position of some implementations, the holder may include one or more airflow passageways that substantially align with one or more airflow intake openings of the cartridge.

FIG. 9 illustrates a perspective view of the removable cartridge 300, according to an example implementation of the present disclosure. In the depicted implementation, the cartridge 300 defines a first end 302 and a distal end 304. The cartridge 300 of the depicted implementation further includes a heat portion 306 comprising a heat source 308, a substrate portion 310 comprising a substrate material 316 (see FIG. 10), and an outer housing 312 configured to circumscribe at least a portion of the heat source 308 and substrate material 316. It should be noted that although in the depicted implementation the cartridge 300 has a substantially cylindrical overall shape, in various other implementations, the cartridge or any of its components may have a different shape. For example, in some implementations the cartridge (and/or any of its components) may have a substantially rectangular shape, such as a substantially rectangular cuboid shape. In other implementations, the cartridge (and/or any of its components) may have other hand-held shapes. Some examples of cartridge configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety.

In some implementations, a barrier may exist between the heat source and the substrate material. In some implementations, such a barrier may comprise a disc that may include one or more apertures therethrough. In some implementations, the barrier may be constructed of a metal material (such as, for example, stainless steel, aluminum, brass, copper, silver, gold, bronze, titanium, various alloys, etc.), or a graphite material, or a ceramic material, or a plastic material, or any combinations thereof. In some implementations, a heat transfer component, which may or may not comprise a barrier, may exist between the heat source and the substrate material. Some examples of heat transfer components are described in U.S. Pat. App. Pub. No. 2019/0281891 to Hejazi et al., which is incorporated herein by reference in its entirety. In some implementations, a barrier and/or a heat transfer component may prevent or inhibit combustion gasses from being drawn through the substrate material (and/or from being drawn through air passageways through which aerosol is drawn).

In various implementations, the heat source may be configured to generate heat upon ignition thereof. In the depicted implementation, the heat source 308 comprises a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Some carbonaceous materials may be composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible. Although specific dimensions of an applicable heat source may vary, in the depicted implementation, the heat source 508 has a length in an inclusive range of approximately 5 mm to approximately 20 mm, and in some implementations may be approximately 12 mm, and an overall diameter in an inclusive range of approximately 3 mm to approximately 8 mm, and in some implementations may be approximately 4.8 mm (and in some implementations, approximately 7 mm).

Although in other implementations the heat source may be constructed in a variety of ways, in the depicted implementation, the heat source 308 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Although in various implementations the heat source may have a variety of forms, including, for example, a substantially solid cylindrical shape or a hollow cylindrical (e.g., tube) shape, the heat source 308 of the depicted implementation comprises an extruded monolithic carbonaceous material that has a generally cylindrical shape that includes a plurality of internal passages 314 extending longitudinally from a first end of the heat source 308 to an opposing second end of the heat source 308. In the depicted implementation there are approximately thirteen internal passages 314 comprising a single central internal passage 314*a*, six surrounding internal passages 314*b*, which are spaced from the central internal passages 314*a* and have a similar size (e.g., diameter) to that of the central internal passage 314*a*, and six peripheral internal passages 314*c*, which are spaced from an outer surface of the heat source 308 and are smaller in diameter than that of the central internal passage 314*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Some implementations may alternatively, or additionally, include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. Pat. App. Pub. No. 2019/0254335 to Spicer et al., which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 10 illustrates a longitudinal cross-section view of the cartridge 300 of FIG. 9. As shown in the figure, the substrate material 316 of the depicted implementation has opposed first and second ends, with the heat source 308 disposed adjacent the first end of the substrate material 316. Although dimensions and cross-section shapes of the various components of the cartridge may vary due to the needs of a particular application, in the depicted implementation the cartridge 500 may have an overall length in an inclusive range of approximately 10 mm to approximately 50 mm and a diameter in an inclusive range of approximately 2 mm to approximately 20 mm. In addition, in the depicted implementation the outer housing 312 may have a thickness in the inclusive range of approximately 0.05 mm to 0.5 mm. Furthermore, in the depicted implementation the substrate portion 310 may have a length in the inclusive range of approximately 5 mm to 30 mm and a diameter slightly less than that of the overall cartridge in order to accommodate the thickness of the housing 312, such as, for example, a diameter in an inclusive range of approximately 2.9 mm to approximately 9.9 mm. In the depicted implementation, the substrate material 316 comprises tobacco beads, which may have diameter sizes in range of approximately 0.5 mm to 2.0 mm, although in other implementations the size may differ. In other implementations, the substrate material may be a granulated tobacco material or cut filler tobacco. Although other implementations may differ, in the depicted implementation the outer housing 312 of the cartridge 300 is filled to about 80-90% capacity to allow for insertion of the heat source 308.

In the depicted implementation, the substrate portion 310 comprises a substrate material 316 having a single segment, although in other implementations the substrate portion may include one or more additional substrate material segments. For example, in some implementations, the aerosol delivery device may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 316 of the depicted implementation).

In the depicted implementation, ignition of the heat source of the cartridge 300 results in aerosolization of the aerosol precursor composition associated with the substrate material. In various implementations, the holder may include an aerosol passageway that extends therethrough. In the depicted implementation, the aerosol passageway extends from the cartridge receiving chamber of the sliding assembly through the main body and mouthpiece portion of the holder. As such, upon a draw applied to the mouthpiece portion of the holder, aerosol generated by the cartridge is configured to be delivered to a user. In some implementations, the aerosol passageway extends from the cartridge receiving chamber to the mouthpiece portion of the holder in a substantially direct path. For example, in some implementations, the aerosol passageway may extend from the cartridge receiving chamber through the holder along a path that is aligned with, or substantially parallel to, a longitudinal axis thereof. In other implementations, however, the aerosol passageway may have a less direct route. For example, the aerosol passageway of some implementations may define an indirect route from the cartridge receiving chamber through the holder, such as, for example, via one or more tortuous paths. In some implementations, for example, such a path may allow the aerosol to cool before reaching a user. In some implementations, such a path may allow mixing of the aerosol with air from outside of the holder. In some implementations, such a path may comprise a serpentine pattern. In other implementations, such a path may include one or more sections that overlap and/or double back toward each other. In other implementations, such a path may comprise one or more spiral turns that extend around an inner diameter of the holder. Other implementations may include combinations of tortuous aerosol paths. Still other implementations may include combinations of direct and tortuous path sections.

In some implementations, the mouthpiece portion, or other portion of the holder may include a filter configured to receive the aerosol therethrough in response to the draw applied to the holder. In various implementations, the filter may be provided, in some aspects, as a circular disc radially and/or longitudinally disposed proximate the end of the holder opposite the receiving end. In this manner, upon a draw on the holder, the filter may receive the aerosol flowing through holder. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the mouthpiece portion may include a filter that may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the cartridge 300 of the depicted implementation, the substrate material 316 comprises a plurality of tobacco beads together formed into a substantially cylindrical portion. In other implementations, however, the substrate material may comprise any one or any combination of tobacco, tobacco beads, gels, alumina, or any one or any combination of other supports with extracts, e-liquids, and/or gels applied. In various other implementations, the substrate material may comprise a variety of different compositions and combinations thereof, as explained in more detail below.

In various implementations, the substrate material may comprise a tobacco material, a non-tobacco material, or a combination thereof. In one implementation, for example, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. patent application Ser. No. 15/905,320, filed on Feb. 26, 2018, and titled Heat Conducting Substrate For Electrically Heated Aerosol Delivery Device, which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., Fund. Appl. Toxicol., 39, p. 11-17 (1997); the disclosures of which are incorporated herein by reference in their entireties.

In still other implementations of the present disclosure, the substrate material may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may include an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally, or alternatively, the substrate material may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as an aerosol precursor composition, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Some casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

In some implementations, the substrate material may comprise a liquid including an aerosol precursor composition and/or a gel including an aerosol precursor composition. Some examples of liquid compositions can be found in U.S. patent application Ser. No. 16/171,920, filed on Oct. 26, 2018, and titled Aerosol Delivery Device With Visible Indicator, which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha* Arventis, *Mentha* c.v., *Mentha niliaca, Mentha piperita, Mentha piperita citrata* c.v., *Mentha piperita* c.v, *Mentha spicata* crispa, *Mentha cardifolia, Memtha longifolia, Mentha suaveolens variegata, Mentha pulegium, Mentha spicata* c.v. and *Mentha suaveolens.*

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie Scotch whisky, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

In the depicted implementation, the substrate material 316 may comprise a centrally defined longitudinally extending axis between the opposed first and second ends, and a cross-section of the substrate material 316 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

As shown in FIGS. 9 and 10, the outer housing 312 of the cartridge 300 of the depicted implementation is configured to circumscribe at least a portion of the substrate portion 310, including the substrate material 316. In the depicted implementation, the outer housing 312 is also configured to circumscribe at least a portion of the heat source 308. In some implementations, the outer housing may circumscribe the entire heat source. In the depicted implementation, the outer housing comprises a rigid material. For example, the outer housing 312 of the depicted implementation is constructed of an aluminum material; however, in other implementations the outer housing may be constructed of other materials, including other metal materials (such as, for example, stainless steel, aluminum, brass, copper, silver, gold, bronze, titanium, various alloys, etc.), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 312 is constructed as tube structure that substantially encapsulates the substrate material 316; however, as noted above, in other implementations the outer housing may have other shapes. Although the shape of the outer housing may vary, in the depicted implementation the outer housing 312 comprises a tube structure having an open end and a closed end. The depicted implementation of the outer housing 312 also includes one or more end apertures 318 located on the closed end of the outer housing 312 that are configured to allow aerosolized vapor (herein alternatively referred to as a "vapor" or "aerosol") to pass therethrough. The end apertures 318 of the depicted implementation are in the form of a pair of elongate rounded slots; however, in other implementations the end apertures may have any form that permits passage of the aerosol therethrough. As such, it will be appreciated that the end apertures 318 can comprise fewer or additional apertures and/or alternative shapes and sizes of apertures than those illustrated.

In various implementations, the heat sink portion of the holder may have a variety of configurations. FIGS. 11A and 11B illustrate two example implementations of a heat sink portion. In the depicted implementation, the heat sink portion comprises a combination of walls and open areas. Referring to FIG. 11A, the heat sink portion 420 of the depicted implementation includes a substantially centrally located cartridge receiving chamber 424 and a plurality of open channels 430 that extend radially from the cartridge receiving chamber 424. The open channels 430 are defined by heat sink walls 450 that also define a plurality of cavities 440 disposed in between the open channels 430, and the receiving chamber 424. In particular, the heat sink walls 450 of the depicted implementation comprise an outer ring 450*a*, and a series of fins 450*b* that extend inward from the outer ring 450*a* toward the receiving chamber 424. As illustrated in the figure, respective pairs of the fins 450*b* of the depicted implementation join together at distal ends thereof to form the receiving chamber 424. Although in various implementations the shape of an open channel may differ, the open channels 430 of the depicted implementation have a substantially U-shaped cross-section (with rounded corners). Although in various implementations the shape of a cartridge receiving chamber may differ, the cartridge receiving chamber 424 of the depicted implementation has a substantially circular cross-section. Although in various implementations the shape of a cavity may differ, the cavities 440 of the depicted implementation have a substantially triangular cross-section (with rounded corners). In such a manner, the heat sink portion 420 of the depicted implementation comprises an alternating series of substantially equally spaced open channels 430 and substantially equally spaced cavities 440. Although in various implementations the number of open channels and/or cavities may vary (including implementations having as few as one slot and/or as few as one cavity), in the depicted implementation there are four open channels 430, separated by four cavities 440.

FIG. 11B illustrates a heat sink portion 520 according to another example implementation of the present invention. In the depicted implementation, the heat sink portion comprises a combination of walls and open areas. In particular, FIG. 11B illustrates a heat sink portion 520 of a holder that includes a substantially centrally located cartridge receiving chamber 524 and a plurality of cavities 540 that substantially surround the cartridge receiving chamber 524. The cavities 524 are defined by heat sink walls 550 that also define the receiving chamber 524. In particular, the heat sink walls 550 of the depicted implementation comprise an outer ring 550*a*, an inner ring 550*b*, and a series of fins 550*b* that extend between the outer ring 550*a* and the inner ring 550*b*. As illustrated in the figure, the outer ring 550*a*, the inner ring 550*b*, and the fins 550*c* of the depicted implementation form the cavities 540. Although in various implementations, the shape of a cartridge receiving chamber and/or a cavity may differ, in the depicted implementation, the cartridge receiving chamber 524 has a substantially circular cross-section, and the cavities 540 have a substantially trapezoidal cross-section (with rounded corners). In such a manner, the heat sink portion 520 of the depicted implementation comprises a series of equally spaced cavities 540 that substantially radially surround the cartridge receiving chamber 524. Although in various implementations the number of cavities may vary (including implementations having as few as one cavity), in the depicted implementation there are fifteen cavities 540. It will be appreciated that the heat sink portion of various implementations of the present disclosure may be employed on other holders. For example, a heat sink portion may be integrated mutatis mutandis into any of the holders described in U.S. Pat. App. Pub. No. 2020/0015519 to Conner et al.; U.S. patent application Ser. No. 16/515,637, filed on Jul. 18, 2019, and titled Aerosol Delivery Device with Consumable Cartridge; U.S. patent application Ser. No. 16/516,573, filed on Jul. 19, 2019, and titled Holder for Aerosol Delivery Device with Detachable Cartridge; U.S. patent application Ser. No. 16/516,601, filed on Jul. 19, 2019, and titled Aerosol Delivery Device with Sliding Sleeve; U.S. patent application Ser. No. 16/516,621, filed on Jul. 19, 2019, and titled Aerosol Delivery Device with Clamshell Holder for Cartridge; U.S. patent application Ser. No. 16/516,821, filed on Jul. 19, 2019, and titled Aerosol Delivery Device with Rotatable Enclosure for Cartridge; and U.S. application Ser. No. 16/516,932, filed on Jul. 19, 2019, and titled Aerosol Delivery Device with Separable Heat Source and Substrate, each of which is incorporated herein by reference in its entirety.

In some implementations, a holder of the present invention may include one or more features configured to release heat through the holder body itself. FIG. 12 illustrates one example implementation of such a feature. In particular, FIG. 12 illustrates a heat release feature 660 comprising an opening disposed proximate a distal end 608 of the main body 602 of a holder. In the depicted implementation, the heat release feature 660 comprises a single elongate opening that is substantially aligned with a longitudinal axis of the holder. In other implementations, however, the heat release feature may comprise any number of openings, which may have any shape or any combination of shapes, and which may have any orientation. For example, a heat release feature of some implementations may comprise a plurality of openings disposed proximate a distal end of a holder. In other implementations, a heat release feature may comprise a single opening that spirals around a portion of the distal end of a holder. It will be appreciated that the heat release feature of various implementations of the present disclosure may be employed on other holders. For example, a heat sink portion may be integrated mutatis mutandis into any of the holders described in U.S. Pat. App. Pub. No. 2020/0015519 to Conner et al.; U.S. patent application Ser. No. 16/515,637, filed on Jul. 18, 2019, and titled Aerosol Delivery Device with Consumable Cartridge; U.S. patent application Ser. No. 16/516,573, filed on Jul. 19, 2019, and titled Holder for Aerosol Delivery Device with Detachable Cartridge; U.S. patent application Ser. No. 16/516,601, filed on Jul. 19, 2019, and titled Aerosol Delivery Device with Sliding Sleeve; U.S. patent application Ser. No. 16/516,621, filed on Jul. 19, 2019, and titled Aerosol Delivery Device with Clamshell Holder for Cartridge; U.S. patent application Ser. No. 16/516,821, filed on Jul. 19, 2019, and titled Aerosol Delivery Device with Rotatable Enclosure for Cartridge; and U.S. application Ser. No. 16/516,932, filed on Jul. 19, 2019, and titled Aerosol Delivery Device with Separable Heat Source and Substrate, each of which is incorporated herein by reference in its entirety.

FIG. 13 illustrates an exploded view of a holder 800, according to another implementation of the present disclosure. As will be described in more detail below, the holder 800 of the depicted implementation is configured to achieve one or more positions via actuation by a user. In the depicted implementation, the holder 800 comprises a main body (or sleeve) 802 that defines a proximal end 806 and a distal end 808 (see FIG. 14), and a sliding assembly 804, which is configured to slide relative to the main body 802. The holder 800 of the depicted implementation further includes an end insert 810. In the depicted implementation, the sliding assembly 804 comprises a button 812, an outlet guide 814, a collar 816, a spring 818, and a carrier 820. The depicted implementation also includes a mouthpiece 822, a pair of sealing members 824, 826, and a ball plunger 828 (which, in some implementations, may include a housing, a spring feature, and a translating ball). In the depicted implementation, the mouthpiece 822 is configured to be inserted into the proximal end 806 of the main body 802, and the mouthpiece 822 is removable therefrom. It should be noted that in some implementations, the mouthpiece may be integral with the main body.

FIG. 14 illustrates a perspective view of the aerosol delivery device 800 and a removable cartridge 300, according to an example implementation of the present disclosure. In some implementations, the holder (or any components thereof) may be made of moldable plastic materials such as, for example, polycarbonate, polyethylene, acrylonitrile butadiene styrene (ABS), polyamide (Nylon), or polypropylene. In other implementations, the holder may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof. In the depicted implementation, the main body 802 is made of a metal material, such as, for example, aluminum, and the mouthpiece is made of a plastic material, such as, for example a polypropylene homopolymer. In some implementations, the main body and mouthpiece are made of the same material. In the depicted implementation, the mouthpiece 822 is separable from the remaining portion of the main body 802, and engages the main body 802 via a snap fit. In various implementations comprising a separable mouthpiece, the mouthpiece may be coupled to the main body in a variety of other ways, including, for example, via an interference fit, screw thread, magnetic, and/or bayonet connection. In other implementations, the mouthpiece may be integral with the main body and thus may not be separable therefrom. The mouthpiece 822 of the depicted implementation is sealed against an inside surface of the main body 802 via one of the sealing members 824, which is received by the mouthpiece 822 within a groove thereof. In the depicted implementation, the sealing members 824, 826 comprise O-rings and are made of a soft polymer material, such as, for example, silicone rubber. The other sealing member 826 of the depicted implementation is received within a groove of the sliding assembly 804 (and in particular, the carrier 820) such that it travels with the sliding assembly 804 relative to the main body 802 between the various positions described below.

In the depicted implementation, the main body 802 includes an elongate button aperture 830 that defines a proximal end 832 and a distal end 834, and that extends along a portion of the length of the main body 802. The button 812 of the sliding assembly 804 of the depicted implementation is configured to extend through the button aperture 830 and is configured to be manually operated by a user to slide the sliding assembly 804 relative to the main body 802. In the depicted implementation, the button 812 is made of a metal material, such as, for example, aluminum; however, in other implementations, the button may be made of any suitable material. In the depicted implementation, the sliding assembly 804 includes an outlet guide 814, which defines a distal end 815. The outlet guide 814 of the depicted implementation also defines a portion of a cartridge receiving chamber 836 (see e.g., FIG. 15B), through which the removable cartridge 300 is inserted or removed. As shown in the figure, a portion of the carrier 820 is exposed through the button aperture 830 regardless of the position of the sliding assembly 804. As also shown in the figure, the carrier 820 includes an air inlet passage 838 that extends through the carrier 820 and into an aerosol passageway, which extends from the outlet end (e.g., the end opposite the heat source end) of an inserted cartridge through the holder 800 and to an opening at the proximal end of the mouthpiece 822 through which a user takes a draw on the device. In various implementations, the size and/or shape (e.g., the diameter and/or cross-section shape) of the air inlet passage may vary and may be designed for particular applications. For example, in some implementations, the size and/or shape of the air inlet passage may have an effect on resistance-to-draw or other user perceived characteristics of the device, and as such, the air inlet passage may be designed to achieve one or more particular user perceived characteristics.

As shown in the detail portion of FIG. 14, the end insert 810 extends beyond the end of the main body 802 and includes a beveled edge (e.g., an edge that angles inward toward the opening thereof). The main body 802 of the depicted implementation further includes an elongate end aperture 840 that extends through the main body 802 so as to expose a portion of the end insert 810. Although not visible in the figure, the depicted implementation includes a similar elongate aperture on the opposite side of the main body 802 that also exposes a portion of the end insert 810. In various implementations, the end insert may be made of any suitable material, as noted above. In the depicted implementation, the end insert 810 is made of a plastic material such as, for example, a glass fiber reinforced thermoplastic material. Further, the end insert 810 of the depicted implementation is transparent or semi-transparent. In such a manner, when the heat source of a cartridge 300 received in the holder 800 of the depicted implementation is ignited, the heat source illuminates the end insert 810. As such, with the structure and positioning of the end insert 810 and the end apertures 840 of the main body 802, a user may be able to determine that the heat source of an inserted cartridge is ignited by viewing the illuminated end insert 810, such as, for example, via the end of the end insert 810 and/or the portions of the end inserts visible through the end apertures 840, both which may be visible to a user from the opposite end (e.g., mouthpiece end) of the device. It should be noted that in other implementations, the main body may include one or more apertures that are different in form or location than those depicted in the figures. In still other implementations, there may be a single aperture or no aperture at all. In the depicted implementation, the end insert 810 snaps into the main body 802 via one or more snap features, although in other implementations the end insert may connect to the main body in a variety of different ways including, for example, via one or more of an interference fit connection, screw thread connection, magnetic connection, and/or bayonet connection. It should also be noted that in some implementations there need not be an end insert, and in other implementations, the end insert may have other configurations. For example, FIG. 21 illustrates a holder 800 and a removable cartridge 300 according to another implementation of the present disclosure. In the depicted implementation, the end insert 810 includes one or more cutouts 841. Although in other implementations the cutouts may extend any depth, in the depicted implementation the cutouts 841 extend through the entire thickness of the end insert 810. In the depicted implementation, respective cutouts 841 align with the end apertures 840 such that an ignited heat source may be directly visible through the end apertures 840.

In some implementations, the distance between the heat source and the closest feature of the holder (such as, for example, in the use position) may be configured to strike a desired balance between providing sufficient access to oxygen while also protecting the heat source. Noting that in other implementations these features may have a variety of different dimensions, with reference to FIG. 21, the heat source of the depicted implementation has an outer diameter of between approximately 4 mm and approximately 5 mm (e.g., in one embodiment, approximately 4.5 mm). The inner diameter of the non-cutout portions of the end insert 810 of the depicted implementation is between approximately 10 mm and approximately 11 mm (e.g., in one embodiment, approximately 10.6 mm). And the inner diameter of the main body 802 of the depicted implementation (such as, for example, proximate the cutout areas 841 of the end insert 810) is between approximately 12 mm and approximately 13 mm (e.g., in one implementation, approximately 12.7 mm). In such a manner, the area of the holder closest to the heat source of the depicted implementation has a heat source clearance gap range between approximately 2.5 mm and approximately 4.5 mm (such as, for example between approximately 3 mm and approximately 4 mm). Moreover, in the depicted implementation, the end insert 810 is configured to provide multiple distinct heat source clearance gaps, each of which falls within the heat source clearance gap range. In addition, in the depicted implementation, a ratio of the diameter of the portion of the holder closest to the heat source to the diameter of the heat source itself is in the range of approximately 2 to approximately 3, and in some implementations, may be in the range of approximately 2.3 to approximately 2.9.

In various implementations, the sliding assembly (or portions thereof) is configured to slide relative to the main body to and from one or more positions. In some implementations, one of the positions is a loading position. FIGS. 15A and 15B illustrate the holder 800 of the depicted implementation in a loading position, in accordance with an example implementation of the present disclosure. Although other implementations of the present disclosure may include a separate lighting position, in the depicted implementation, the loading position also comprises a lighting position. In the loading position of various implementations, the distal end of the outlet guide may be located at any position relative to the distal end of the holder. In the loading position illustrated in FIGS. 15A and 15B, the distal end of the outlet guide 814 is configured to be located proximate the distal end 808 of the main body 802 (more particularly, a distal end of the end insert 810). In the loading position of various implementations, the button of the sliding assembly may be positioned at any location in the button aperture. In the loading position illustrated in FIGS. 15A and 15B, the button 812 of the depicted implementation is configured to be positioned between the proximal end 832 and the distal end 834 of the button aperture 830. More particularly, in the loading position of the depicted implementation, the button 812 is positioned between the midway point of the button aperture 830 and the distal end 834 of the button aperture 830. In the loading position of other implementations, the button may have another position. For example, in the loading position of some implementations, the button of the sliding assembly may be positioned proximate the midway point of the button aperture, or at a position between the midway point of the button aperture and the proximal end of the button aperture. In the depicted implementation, the air inlet passage 838 is exposed through the button aperture 830 in the loading position such that air may be introduced into the aerosol passageway through the air inlet passage 838 when a user draws on the device 800. In the depicted implementation, a detent features 842 temporarily locates the sliding assembly in the loading position. In particular, the main body 802 of the depicted implementation includes a recessed area 842 on an inside surface thereof that is configured to receive the spring-loaded ball portion of the ball plunger 828 in the loading position. It should be noted that in other implementations, one or more alternate features may serve to temporarily locate the sliding assembly in the loading position. Other implementations, however, need not include any such features.

As will be described in more detail below, the holder of the depicted implementations of the present invention also includes a cartridge retention feature configured to retain a cartridge in the receiving chamber in one or more positions of the holder. In the depicted implementation, a protruding feature 846 of the collar 816 is configured to form an interference fit around an outer circumference of a corresponding portion of the cartridge 300 in order to retain the cartridge 300 in the receiving chamber 836 of the holder 800. In the depicted implementation, the protruding feature 846 is a protruding ring that has an overall inner diameter that is smaller than an overall outer diameter of a corresponding portion of the cartridge 300. In such a manner, the resilient protruding feature 846 of the depicted implementation contacts a periphery of the cartridge at the corresponding portion. In the depicted implementation, in order to load the cartridge 300 in the holder 800, the cartridge 300 is inserted into the receiving chamber 836 until the outlet end of the cartridge 300 (e.g., the end opposite the heat source) abuts a contact end 825 of the carrier 820. In such a manner, the contact end 825 of the carrier 820 is located proximate the end apertures of the cartridge 300 providing a path for aerosol from the cartridge to flow into the aerosol passageway defined in the carrier 820 and mouthpiece 822. In the loading position of the depicted implementation, the contact end 825 of the carrier 820 is positioned downstream (e.g., closer to the mouthpiece 822) from the protruding feature 846 such that in the loading position, the protruding feature 846 contacts the outer housing of the cartridge 300 and retains it.

In other implementations, however, other retaining features may be used. For example, in some implementations one or more retention spheres may form part of a cartridge retention assembly. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets.

As noted, in various implementations, the sliding assembly (or portions thereof) is configured to slide relative to the main body to and from one or more positions. In some implementations, one of the positions may be a use position. FIGS. 16A and 16B illustrate the holder 800 of the depicted implementation in a use position, according to one example implementation of the present disclosure. In the use position of various implementations, the distal end (e.g., the distal end of the heat source end) of the cartridge may be located at any position relative to the distal end of the holder. In the use position illustrated in FIGS. 16A and 16B, the distal end of the cartridge is configured to be located proximate the distal end of the main body 802, and in particular, proximate the distal end of the end insert 810. More particularly, in the use position of the depicted implementation, the distal end of the cartridge 300 is located proximate but inside of (e.g., not extending beyond or outside of) the end insert 810. In the use position of various implementations, the button of the sliding assembly may be positioned at any location within the button aperture. In the use position illustrated in FIGS. 16A and 16B, the button 812 of the depicted implementation is configured to be positioned proximate the proximal end 832 of the button aperture 830. In the depicted implementation, the air inlet passage 838 is exposed through the elongate button aperture 830 in the use position such that air may be introduced into the aerosol passageway through the air inlet passage 838 when a user draws on the device 800. In the depicted implementation, a detent feature 844 temporarily locates the sliding assembly in the use position. In particular, the main body 802 of the depicted implementation includes a recessed area 844 on an inside surface thereof that is configured to receive the ball of the ball plunger 828 in the use position. It should be noted that in other implementations, one or more alternate features may serve to temporarily locate the sliding assembly in the use position. Other implementations, however, need not include any such features. In the use position of the depicted implementation, the outlet end of the cartridge 300 (e.g., the end opposite the heat source end) abuts the contact end 825 of the carrier 820, and, as with the loading position, the protruding feature 846 of the collar 816 maintains an interference fit around an outer circumference of the cartridge 300 (see also FIG. 18) in order to retain the cartridge 300 in the receiving chamber 836 of the holder 800.

As noted, in various implementations, the sliding assembly (or portions thereof) is configured to slide relative to the main body to and from one or more positions. In some implementations, one of the positions may be a releasing position. FIGS. 17A and 17B illustrate the holder 800 of the depicted implementation in a releasing position, in accordance with an example implementation of the present disclosure. In the releasing position of various implementations, the distal end of the outlet guide may be located at any position relative to the distal end of the holder. In the releasing position illustrated in FIGS. 17A and 17B, the distal end of the outlet guide 814 is configured to extend beyond (e.g., past) the distal end of the main body 802. In the releasing position of various implementations, the button of the sliding assembly may be positioned at any location in the elongate button aperture. In the releasing position illustrated in FIGS. 17A and 17B, the button 812 is configured to be positioned proximate the distal end 834 of the elongate button aperture 830. In the releasing position of the depicted implementation, the main body 802 does not include a detent, and when a user is not holding the sliding assembly in the releasing position, the spring 818 of the sliding assembly urges the carrier 820 back toward the detent 842 associated with the loading position. In other implementations, however, a detent may be associated with the releasing position and/or the spring may not urge the carrier away from the releasing position.

In the releasing position of the depicted implementation, the cartridge retention feature 846 no longer engages the cartridge 300. In such a manner, the cartridge 300 is disengaged from the holder 800 such that it can freely fall from, drop from, be ejected from, and/or be easily removed from the holder 800. Reference is made to FIG. 19, which illustrates a cross-section view of a distal end of the holder 800 and removable cartridge 300 in the releasing position. As illustrated in FIG. 19, when moving from the use position to the releasing position, the contact end 825 of the carrier 820 pushes the cartridge 300 in the distal direction to a location wherein the contact end 825 of the carrier is located upstream (e.g., closer to the distal end 808 of the holder 800) from the protruding feature 846. In such a manner, the protruding feature 846 no longer contacts any portion of the cartridge 300, thereby no longer retaining the cartridge 300. By comparison, FIG. 18 illustrates a cross-section view of a distal end of the holder 800 and removable cartridge 300 in the use position. As shown in the figure, in the use position, the contact end 825 of the carrier 820 is located upstream (e.g., closer to the mouthpiece 822) from the protruding feature 846. In such a manner, the protruding feature contacts the outer periphery of the housing of the cartridge 300 thereby retaining it.

In various implementations, the outlet guide of the holder may have a variety of configurations. For example, in some implementations the outlet guide may have an end shape similar to those shown in FIGS. 11A and 11B. In other implementations, the outlet guide may have other end shapes. FIG. 20 illustrates an end view of the holder according to another example implementation of the present disclosure. In the depicted implementation, the outlet guide comprises a combination of walls and open areas. Referring to FIG. 20, the outlet guide 814 of the depicted implementation includes a portion of a substantially centrally located cartridge receiving chamber 836, and a pair of channels 850*a*, 850*b* that extend outwardly from opposite sides of a portion of the receiving chamber 836. The height and width of the channels 850*a*, 850*b* of the depicted implementation are less than the diameter of the portion of the receiving chamber 836 located in the outlet guide 814 and/or the outer diameter of a cartridge. In addition to the channels 850*a*, 850*b*, the outlet guide 814 also includes four cavities, 854*a*, 854*b*, 854*c*, 854*d*, two of which 852*a*, 852*b*, are located on one side of the channels 850*a*, 850*b*, and two of which 852*c*, 852*d* are located on the other side of the channels 850*a*, 850*b*. In the depicted implementation, the height and width of the cavities 852*a*, 852*b*, 852*c*, 852*d* are less than the diameter of the portion of the receiving chamber 836 located in the outlet guide 814 and/or the outer diameter of a cartridge. In the depicted implementation, the open channels 850*a*, 850*b* and cavities 852*a*, 852*b*, 852*c*, 852*d* are defined by walls 854. Although other configurations are possible, in the depicted implementation, the channels 850*a*, 850*b* and cavities 852*a*, 852*b*, 852*c*, 852*d* extend in the longitudinal direction only a portion of the length of the outlet guide 814. Although in various implementations the shape of a cartridge receiving chamber may differ, the portion of the cartridge receiving chamber 836 of the depicted implementation has a substantially circular cross-section. Although in various implementations the shape of an open channel or cavity may differ, in the depicted implementation, both of the open channels 850*a*, 850*b* has a U-shape and each of the cavities 852*a*, 852*b*, 852*c*, and 852*d*, has a kidney shape. In the depicted implementation, the end of the outlet guide is angled inward (e.g., toward the mouthpiece end of the device, see e.g., FIGS. 18 and 19). In such a manner, the angled walls outlet guide 814 may aid in guiding a cartridge into the receiving chamber.

It will be appreciated that the outlet guide of various implementations of the present disclosure may be employed on other holders. For example, an outlet guide may be integrated mutatis mutandis into any of the holders described in U.S. Pat. App. Pub. No. 2020/0015519 to Conner et al.; U.S. Pat. App. Pub. No. 2021/0015173 to Cox et al.; U.S. Pat. App. Pub. No. 2021/0015174 to Cox et al.; U.S. Pat. App. Pub. No. 2021/0015175 to Jackson et al.; U.S. Pat. App. Pub. No. 2021/0015172 to Conner et al.; U.S. Pat. App. Pub. No. 2021/0015176 to Conner et al.; and U.S. App. Pub. No. 2021/0015177 to Cox et al., each of which is incorporated herein by reference in its entirety.

As described above, the holder of various implementations of the present disclosure is configured to move to and from a loading position a use position, and/or a releasing position. In some implementations, the holder may also have an extinguishment position. In such a manner, the extinguishment position may be configured such that the heat source of a cartridge is deprived of sufficient oxygen to sustain combustion. In some implementations, the extinguishment position may be obtained by a further action of the holder. In other implementations, one or more additional features may be included such that an extinguishment position may be achieved by actuating the one or more additional features. In particular, the holder of one implementation may include an air impermeable cover feature located proximate the distal end of the holder that may be mechanically or manually actuatable (e.g., by rotating the cover feature over the end of the main body and/or by sliding the cover feature across the end of the main body) such that in the extinguishment position, the cover feature substantially covers the open end of the holder and the heat source of the cartridge is deprived of sufficient oxygen to sustain combustion. In another implementation, the holder may include a detachable feature, such as, for example, an end cap, that may be used to achieve the extinguishment position. For example, in some implementations a separate end cap may be attachable over the distal end of the holder such that, once attached, the heat source of the cartridge is deprived of sufficient oxygen to sustain combustion. Such an end cap could also be used to cover the end of the second body portion when not in use, such as, for example, to prevent dirt and/or foreign objects from entering into the device. Additionally, or alternatively, in some implementations the holder of the present disclosure may include an air permeable cover feature (e.g., a cover feature comprising a plurality of openings or a cover feature comprising a mesh) that protects the heat source of the cartridge in the use position. For example, the holder of one implementation may include an air permeable cover feature located proximate the distal end of the holder that may be mechanically or manually actuatable (e.g., by rotating the cover feature over the end of the holder and/or by sliding the cover feature across the end of the holder) such that once ignited, the cover feature may be actuated to substantially cover the open end of the holder while maintaining sufficient access of oxygen to the heat source.

In the depicted implementations, the holder includes walls that are substantially solid and non-porous; however, in other implementations one or more of these walls of a holder may have other configurations. For example, in some implementations one or more of the walls of a holder may be non-solid and/or substantially porous or may include one or more non-solid and/or substantially porous portions. In some implementations, for example, the holder may include one or more apertures that may facilitate access of oxygen to the heat source. Alternatively, or additionally, other implementations may include one or more apertures that may mix with the aerosol generated during a draw. In such a manner, in the use position the one or more apertures may be located proximate the heat source, thus providing the heat source with additional access to oxygen during combustion. In some implementations, the holder may include one or more apertures downstream from the heat source. For example, in some implementations the holder may include apertures that extend into the aerosol passage of the holder that may mix with aerosol generated by the substrate material of the cartridge.

In various implementations, the present disclosure may also be directed to kits that provide a variety of components as described herein. For example, a kit may comprise a holder with one or more cartridges. In another implementation, a kit may comprise a plurality of holders. In further implementations, a kit may comprise a plurality of cartridges. In yet another implementation, a kit may comprise a plurality of holders and a plurality of cartridges. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a cartridge receiving chamber of the holder, or, in other implementations, inserted in a separate aperture that enables a user to remove debris from the cartridge receiving chamber.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a removable cartridge comprising a substrate portion that includes a substrate material having an aerosol precursor composition configured to form an aerosol upon application of heat thereto; and a holder comprising a main body defining a proximal end and a distal end, the main body further providing an aerosol passageway that extends through at least a portion of the main body, and a heat sink portion, wherein at least part of a receiving chamber is located in the heat sink portion, wherein the heat sink portion is configured to dissipate heat from the cartridge, wherein the heat sink portion is movable in both a proximal direction and an opposite distal direction relative to the main body, and wherein the cartridge is separate from and removable from the heat sink portion of the holder.

2. The aerosol delivery device of claim 1, wherein the heat sink portion comprises heat sink walls that define a plurality of open channels, and wherein the plurality of open channels substantially surround the receiving chamber.

3. The aerosol delivery device of claim 1, wherein the heat sink portion comprises heat sink walls that define a plurality of cavities, and wherein the plurality of cavities substantially surround the receiving chamber.

4. The aerosol delivery device of claim 1, wherein the main body further comprises at least one heat release feature comprising at least one opening located proximate the distal end thereof.

5. The aerosol delivery device of claim 1 further comprising a cartridge retention assembly, and a sliding assembly at least a portion of which is located within the main body, the sliding assembly including the heat sink portion, wherein the sliding assembly is configured to slide relative to the main body to and from at least:

a loading position, wherein the cartridge retention assembly is configured to receive the cartridge, and a use position, wherein the cartridge retention assembly is configured to retain the cartridge.

6. The aerosol delivery device of claim 5, wherein in the loading position, the cartridge retention assembly is configured to retain the cartridge.

7. The aerosol delivery device of claim 5, wherein the sliding assembly is further configured to slide relative to the main body to and from a releasing position, wherein in the releasing position, the cartridge retention assembly does not retain the cartridge.

8. The aerosol delivery device of claim 5, wherein the sliding assembly further comprises a carrier that includes the heat sink portion and a button feature configured to be manually operated by a user to slide the sliding assembly.

9. The aerosol delivery device of claim 8, wherein the main body further comprises an elongate aperture, and wherein the button extends through the aperture and is configured to slide therein.

10. The aerosol delivery device of claim 1, wherein the cartridge further comprises a heat portion including a heat source configured to generate heat.

11. The aerosol delivery device of claim 10, wherein the substrate portion is disposed proximate the heat source.

* * * * *